United States Patent [19]

Shibuya et al.

[11] 4,449,705

[45] May 22, 1984

[54] PAPER FEED DEVICE

[75] Inventors: Kunihiro Shibuya, Yokohama; Kohachi Uchida, Sagamihara, both of Japan

[73] Assignee: Tokyo Shibaura Denki Kabushiki Kaisha, Kawasaki, Japan

[21] Appl. No.: 236,283

[22] Filed: Feb. 18, 1981

[30] Foreign Application Priority Data

| | | | |
|---|---|---|---|
| Feb. 18, 1980 | [JP] | Japan | 55-18694 |
| Feb. 22, 1980 | [JP] | Japan | 55-21187 |
| Feb. 22, 1980 | [JP] | Japan | 55-21188 |
| Feb. 26, 1980 | [JP] | Japan | 55-22917 |
| Feb. 29, 1980 | [JP] | Japan | 55-25081 |
| Jun. 4, 1980 | [JP] | Japan | 55-75153 |
| Jun. 4, 1980 | [JP] | Japan | 55-75154 |

[51] Int. Cl.[3] ..... B65H 3/44

[52] U.S. Cl. ..... 271/9; 271/164

[58] Field of Search ..... 271/9, 152, 162, 164

[56] References Cited

U.S. PATENT DOCUMENTS

| | | | |
|---|---|---|---|
| 3,598,396 | 8/1971 | Andrews | 271/9 |
| 4,204,668 | 5/1980 | Yanagawa | 271/9 |
| 4,265,440 | 5/1981 | Shibazaki | 271/9 |

FOREIGN PATENT DOCUMENTS

| | | |
|---|---|---|
| 50-1210 | 1/1975 | Japan . |
| 54-16108 | 6/1979 | Japan . |
| 54-24788 | 8/1979 | Japan . |

*Primary Examiner*—Richard A. Schacher

*Attorney, Agent, or Firm*—Cushman, Darby & Cushman

[57] ABSTRACT

A paper feed device according to the invention comprises a paper feed cassette accommodating paper sheets and a paper feed mechanism for feeding out paper from the cassette. It also comprises a manual paper supply guide provided on top of the cassette for advancement and retreat therealong and having a paper guide surface for guiding manual supply paper. The detection of whether paper is present in the paper feed cassette and also the detection of a paper sheet being fed over the manual paper supply guide in a manual paper feed supply mode are effected by a single detecting switch.

11 Claims, 34 Drawing Figures

OUTPUT OF TIMER 240

OUTPUT OF DELAY CIRCUIT 242

OUTPUT OF INTEGRATOR 234

OUTPUT OF INVERTER 236

OUTPUT OF AND CIRCUIT 238

PAPER FEED DEVICE

BACKGROUND OF THE INVENTION

This invention relates to improvements in the paper feed device for duplicators.

Paper feed devices for electronic duplicators are mostly based upon cassette paper supply from paper feed cassette.

However, with a device which is designed to permit only cassette paper supply, inconvenience is felt in case when it is desired to manually supply a paper sheet of a different size from that of paper accommodated in the paper feed cassette.

Accordingly, it has been proposed to provide the duplicator with two separate exclusive paper feed devices for cassette paper supply and manual paper supply so that paper can be readily supplied in either cassette or manual paper supply mode. However, where such two separate paper feed devices are used, a detection switch system for detecting the absence of paper in the paper feed cassette and a detection switch system for detecting the passage of paper in case of the manual paper supply are needed. Such detection switch systems require extra space and increase the size of the paper feed system as well as complicating the paper feed system with wirings involved.

In another aspect, with duplicators for use with paper feed cassette as mentioned above, the paper feed system is usually constituted by a plurality of paper feed mechanisms provided in the duplicator, and paper feed cassettes accommodating paper sheets of different sizes, for instance, A4, B4 and B5 sizes, are loaded in paper feed sections of the respective paper feed mechanisms so that cassette paper sheets of desired sizes can be automatically supplied by operating the corresponding paper feed mechanisms. In some duplicators where a plurality of paper feed cassettes are loaded for use, there is a trend of loading a plurality of cassettes accommodating paper of the size of frequent use in order to save time required for renewing cassette and obtain as efficient copying operation as possible.

However, as is well known in the art, the paper feed systems for such duplicators are constructed such that paper supply is automatically stopped when the cassette in use has run out of paper sheets. This occurs even if other cassettes accommodating paper of the same size are loaded in the duplicator. If this occurs while operator has left the duplicator on an errand by thinking that he would return by the time when the scheduled copying operation is over, the copying will not be ended as scheduled, which is disadvantageous.

In a further aspect, in the electronic duplicator it is usual to make optical scanning of original document, on-off control of charging or development according to the length of the copying paper sheet. The length of the copying paper sheet is usually detected through the detection of the trailing edge of paper sheet being transported, for instance by a detecting means provided in the paper transport path of the paper feed device. FIGS. 1 and 2 show examples of the prior-art paper feed device provided with a detecting means.

The detecting means shown in FIG. 1 comprises an actuator 4 provided in the paper transport path 2 and a detection switch 6 provided near the path 2 on either side thereof and coupled to the actuator 4 by a rotatable member 8. The actuator 4 is adapted to be operated, for instance swung up or down, by a copying paper sheet being fed into the transport path 2, and the passage of the trailing edge of the paper sheet 10 by the actuator is detected by the detection switch 6. In the Figure, designated at 12 is a paper feed cassette, at 14 upper and lower guides constituting the paper transport path, and at 16 a paper feed roller unit.

The detecting means shown in FIG. 2 comprises photoelectric cells 18 disposed on the upper and lower sides of paper transport path 2 in vertical alignment to each other. With this arrangement, the trailing edge of copying paper sheet 10 being fed to the paper transport path 2 is detected in terms of whether light is transmitted through the paper transport path. In FIGS. 1 and 2 like parts are designated by like reference numerals, and redundant description is dispensed with.

However, in order for such detecting means with the detecting section provided in the paper transport path 2 to be able to detect the trailing edge of the paper sheet 10, the detecting section has to be disposed such that the distance between it and a transfer section is greater than the distance between a photosensitive drum charger and the transfer section along the photosensitive drum. This means that the provision of the detecting section is impossible with a small-size duplicator provided with a paper transport path where the distance between the paper feed section and transfer section is too small.

In the detecting means having the actuator 4 as shown in FIG. 1 disposed on the paper feed path 2, jamming tends to occur in the supply of the copying paper and thus a smooth paper supply of the copying paper is prevented. A detecting means disposing photoelectric elements 18, 18 (see FIG. 2) on a paper feed path 2 provides no "jamming" problem, but when it is desired to detect a copying paper 10 of, for example, a thin type having a higher degree of transparency to light, difficulty is encountered in detecting the trailing edge of the copying paper.

Further, where a plurality of paper feed cassettes are provided, it is necessary to provide a corresponding number of detecting sections with the aforementioned constructions of the detecting means with the detecting section disposed in a predetermined position of the paper transport path 2, which leads to complications of the detecting system.

In a still another aspect, in case of the paper feed device which is capable of permitting paper supply in a cassette paper supply mode and also in a manual paper supply mode, a manual paper supply door is provided, the cassette paper supply mode or manual paper supply mode can be selectively obtained by opening or closing this door. With this type of paper feed device, the door is closed or opened to recover the cassette paper supply mode after the manual supply of paper is ended. However, it is often the case that the door is left in its state of manual paper supply even after the end thereof, and this leads to the malfunction of causing copying operation by cassette paper supply while the cassette paper supply mode is not recovered.

As for further prior-art, Japanese Patent Publication No. 50-1210, N. Yanagawa, Jan. 16, 1975, discloses "automatic paper supply cut-off device in manual paper supply in duplicator provided with cassette paper feed device and repeat mechanism". This disclosure teaches that in a duplicator of automatic paper supply type provided with a cassette paper feed device and a repeat mechanism, in which automatic cassette paper supply is interrupted to permit manual paper supply even with the operation of a manual paper sheet length detection switch.

Also, Japanese Patent Application No. 54-16108, S. Komori et al, June 20, 1979, entitled "Paper Feed Cassette Device" discloses a paper feed cassette device, which comprises a paper feed cassette accommodating paper sheets, a paper feed means for feeding paper sheets from the cassette and a manual paper supply table for manually feeding a paper sheet different from those accommodated in the cassette, and in which the paper feed means can feed the different paper sheet supplied from the manual paper supply table as well.

Further, Japanese Patent Publication No. 54-24788, Y. Hatanaka et al, Aug. 23, 1979, entitled "Method of and Device for Detecting Jamming of Sheets", discloses method of and device for accurately detecting jamming irrespective of the position of sheet being transported.

However, none of the above disclosures contains a construction capable of automatically switching a manual paper supply mode over to a cassette paper supply mode in response to the end of manual paper supply.

SUMMARY OF THE INVENTION

An object of the invention is to provide a paper feed device, which can detect the absence of paper in a paper feed cassette and a manual paper supply mode with a single switch and thus permit size reduction and simplification of the construction.

Another object of the invention is to provide a paper feed device which, when used with a plurality of paper feed cassettes accommodating paper of the same size, can automatically switch cassettes one over to another when the previous one has run out of paper sheets, thus permitting successive paper supply without unnecessary interruption and providing improved convenience.

A further object of the invention is to provide a paper feed device, in which a paper feed roller is also used as a paper detecting section to permit reliable and early detection of the trailing edge of whatever size of paper sheet and eliminate the likelihood of jamming, and which is particularly useful for a small-size duplicator.

A still another object of the invention is to provide a paper feed device, which can detect the trailing edge of paper sheet supplied from a plurality of paper feed cassettes with a single detecting means, thus permitting the simplification of the detecting system for a duplicator for use with a plurality of paper feed cassettes.

A yet another object of the invention is to provide a paper feed device, in which a manual paper supply mode can be automatically and reliably switched back to a cassette paper supply mode, thus simplifying the operation control and eliminating malfunction due to otherwise possible negligence of restoration of the cassette paper supply mode, and also in which the restoration of the cassette paper supply mode is effected in response to a signal from a paper supply switch for the cassette paper supply mode, thus permitting continuous manual supply of paper sheets.

A still further object of the invention is to provide a paper feed device, in which, while a manual paper supply mode can be automatically and reliably switched back to a cassette supply mode to thereby simplify the operation control and eliminate malfunction due to otherwise possible negligence or restoration of the cassette paper supply mode, the restoration of the cassette paper supply mode is effected in response to a signal from a timer which is rendered operative at the time of the establishment of the manual paper supply mode, thus permitting reliable and ready manual paper supply operation and reduction of time required for obtaining a first copy in the cassette paper supply after the end of the manual paper supply.

To achieve the aforementioned objects, the paper supply device according to the invention comprises a paper feed cassette accommodating a stack of paper sheets, a manual paper supply guide provided for advancement and retreat along the top of the paper feed cassette and having a paper guide surface for guiding manually supplied paper, and a detecting switch means for detecting whether paper is present in the paper feed cassette and also detecting a paper sheet being fed over the manual paper supply guide in a manual paper feed supply mode.

According to the invention, the absence of paper at the time of the cassette paper supply mode can be detected with a single detection switch, and the state of paper supply in the manual paper supply mode can be reliably detected with a single detection switch. Thus, it is possible to reduce the number of detection switch systems that have hitherto been necessary, thus permitting the size reduction and simplification of the paper feed device and hence the size reduction of the duplicator. Besides, with the reduction of the detection switch systems the wiring that is involved can be greatly reduced, the processing of the detection switch system output signals is facilitated, and the paper feed device itself is simplified to permit cost reduction.

Also, according to the invention a paper size detecting means for detecting the size of paper in a paper feed cassette and an absence-of-paper detecting means for detecting the absence-of-paper in the cassette are provided in a paper feed section of each of paper feed mechanism stages, and there is also provided a control circuit, which receives the output signals from the individual paper size detecting means and absence-of-paper detecting means and, when a cassette of a given paper size used exhausts paper sheets during the cassette paper supply, functions to find out a cassette accommodating paper sheets of the same size from among the other cassettes and supply a control output signal to a paper feed mechanism switching means to switch paper feed mechanism so as to permit successive cassette paper supply from the selected cassette containing paper sheets of the same size. Thus, even if the cassette in use has run out of paper sheets during the cassette paper supply, the paper supply operation can be continued without interruption inasmuch as the duplicator contains another cassette accommodating paper sheets of the same size. In other words, the scheduled copying operation can be completed even if the operator has been left the duplicator at the time of the absence of paper. In addition, where paper of a fixed size is supplied, the time changing paper feed cassettes can be saved.

Further, according to the invention a paper transport means is provided ahead of the paper supply roller in the direction of paper supply for successively a paper sheet fed to it, and while the paper sheet is being transported by the paper transport means the paper feed roller is adapted to be driven thereby via the paper so that the trailing edge of the paper can be detected from the stopping of the paper feed roller by a paper sheet trailing edge detecting means. Thus, it is possible to reliably detect the trailing edge of whatever size of paper sheet without need of providing any obstructive member to the paper transport in the transport path. In addition, jamming hazard can be eliminated. Further, since the trailing edge of paper is detected from the stopping of the paper feed roller, it is possible to minimize the length of transport path required for the detection, which is useful where early detection of the trailing edge is desired and also very useful for a small-size duplicator. Furthermore, if the trailing edge detecting means has a contact-free construction with respect to the paper feed roller, reliable detection of the paper sheet trailing edge can be ensured without giving any undesired extra load to the paper feed roller and also without imposing any demerit to the device as a whole.

Still further, in an arrangement in which a paper transport means is provided ahead of each of a plurality of paper feed roller sets such that while a transport means is transporting a paper sheet the associated paper feed roller set is driven thereby and permits detection of the trailing edge of the paper sheet from its stopping by a paper sheet trailing edge detecting means, only a single detecting means can be used for detecting the trailing edge of paper fed from any of the paper feed cassettes in co-operation with the respective paper feed roller sets. Thus, it is possible to reduce detecting elements and associated wiring and control circuits for the paper feed system of a duplicator for use with a plurality of paper feed cassettes.

Yet further, with the paper feed device according to the invention the restoration of the cassette paper supply mode from the manual paper supply mode can be automatically and reliably obtained, so that the operation can be extremely simplified and it is possible to eliminate malfunction that has hitherto been resulted from the negligence of restoring the cassette paper supply mode. In addition, since the automatic restoration is effected in response to a signal from a paper supply switch for the cassette paper supply, i.e., at the commencement of the cassette paper supply, it is possible to successively supply paper sheets in the manual paper supply mode.

Furthermore, according to the invention the aforementioned automatic restoration of the cassette paper supply mode from the manual paper supply mode can be effected in response to the output signal from a timer, which is rendered operative at the time of the establishment of the manual paper supply mode, that is, the restoration can be obtained after a constant period of time from the establishment of the manual paper supply mode. Thus, by providing sufficient redundancy in setting the timer period, it is possible to obtain reliable and ready manual paper supply operation. In addition, since no period is needed for the automatic restoration after a copying start switch is turned on, the period required until a first copy is obtained by cassette paper supply after the end of the manual paper supply can be extremely reduced. Further, by resetting the timer every time a paper sheet is supplied, in case of continuously supplying paper sheets in manual paper supply mode the automatic restoration can be obtained substantially after a constant period of time from the end of copying, and thus the operation control in the case of the manual paper supply mode can be improved.

The aforementioned and other objects and features of the present invention will be apparent from the following description taken in connection with the accompanying drawings, in which:

DETAILED DESCRIPTION OF THE PREFERRED EMBODIMENTS

Figure 1:
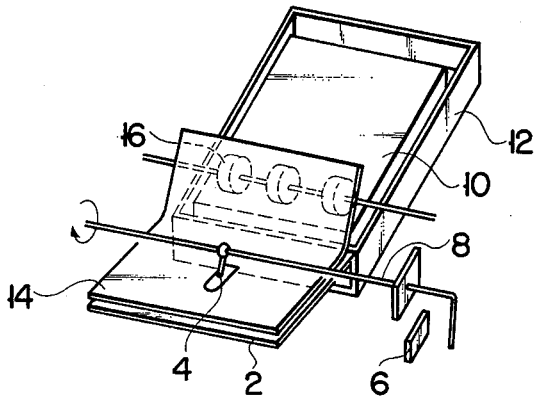
FIG. 1 (PRIOR ART)
FIGS. 1 and 2 are perspective views respectively showing different prior-art paper feed devices.
Figure 2:
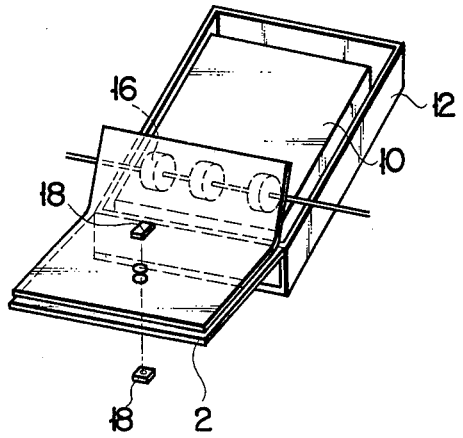
FIG. 2 (PRIOR ART)
Figure 3:
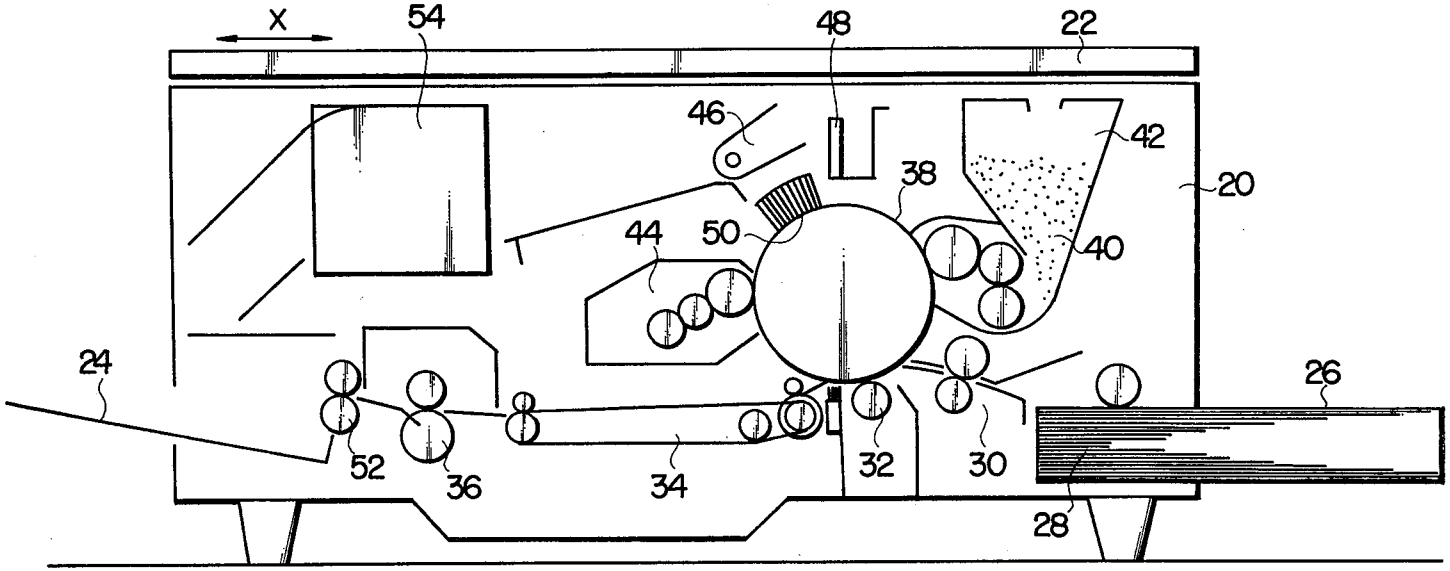
FIG. 3 is a schematic view showing an electronic duplicator incorporating a paper feed device according to the invention.

FIG. 3 shows a schematic view of an electronic duplicator incorporating a paper feed device according to the invention. Referring to the Figure, designated at 20 is the duplicator, which includes an operation panel having a display section provided on an upper portion of one side wall of its frame. The duplicator 20 also includes a document table 22 which is reciprocable in the directions of arrow X. It further includes a copy tray 24 detachably provided in its frame on the left side thereof in the Figure and also a paper feed cassette 26 loaded in it on the right side and accommodating copying paper sheets P. It further includes a paper feed mechanism 30 for feeding paper 28 in the paper feed cassette 26, a transfer mechanism 32, a transport mechanism 34, a fixing mechanism 36, a photosensitive drum 38, a developing unit 42 containing toner 40, a photosensitive drum cleaning mechanism 44, an illuminating system 46, an optical-fiber lens system 48, a charger 50, transport rollers 52 and a motor for synchronously driving the original support plate 22 and photosensitive drum 38, these parts being all disposed inside its frame. In this duplicator, an original held on the original support plate 22 is illuminated from the illuminating system 46, and its light image is focused on the photosensitive drum surface through the optical-fiber lens system 48. Meanwhile, in synchronism to the rotation of the photosensitive drum 38 copying paper sheets 28 are taken out from the paper feed cassette 26 and supplied to a transfer position under the photosensitive drum 38 one after another by the paper feed mechanism 30. As each copying paper sheet 28 is fed to the transfer position, transfer of a developed image formed by the toner 40 in the developing unit 42 onto the sheet 28 is caused by the transfer mechanism 32. The sheet 28 with the developed image thereon is then guided through the transport mechanism 34 to the fixing mechanism 36 for fixing the transferred image before it is brought into the copy tray 24. After the transfer of each developed image, the photosensitive drum 38 proceeds past the cleaning mechanism 44 whereby its surface is cleaned.

Figure 4:
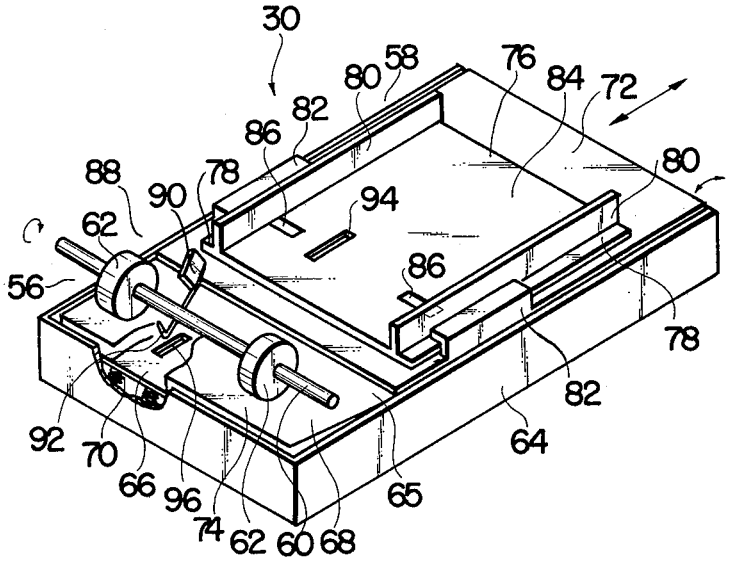
FIG. 4 is a perspective view showing an embodiment of the paper feed device according to the invention, in which the absence of paper in a paper feed cassette and a manual paper supply mode can be detected by a single switch.

FIG. 4 shows a perspective view of an embodiment of the paper feed device 30 according to the invention. It comprises a paper feed section 56 and a cassette section 58.

The paper feed section 56 includes a rotative shaft 60, which carries a plurality of, for instance two, paper feed rollers 62, 62 made of rubber or the like and spaced apart in its axial direction and is mounted as a component part of duplicator inside the frame thereof.

The cassette section 58, as shown in FIG. 4, includes a paper feed cassette 64, which is open at its top 65 and accommodates an underlay plate 66. Originally, the cassette 64 accommodates a stack of paper sheets 68 supported on the underlay plate 66. The cassette 58 also accommodates coil springs 70 upwardly urging the underside of a front portion of the underlay plate 66 and the paper sheet stack 68. A rear portion of the top opening 65 of the cassette 64 is closed by a cassette cover 72. The cassette cover 72 has a rectangular shape, and its opposite sides are pivoted at the rear end to the rear end of the opposite side walls of the cassette 64.

A cassette paper supply section 74 is constituted by the front portion of the cassette 64 which is not covered by the cassette cover 72, that is, in which the top of the accommodated paper sheet stack 68 is exposed. In other words, the cassette 64 is set in a predetermined position such that the top of the paper sheet stack 68 is in contact with the feed rollers 62, 62. In this state of the cassette, the accommodated paper sheet stack 68 can be fed out one after another with the rotation of the feed rollers 62, 62, that is, cassette paper supply can be obtained. For manual paper supply, a manual paper supply guide 76 is provided on the cassette cover 72. It has opposite side guide edges 78 and vertical guide walls 80. The guide edges 78 are engaged in respective guide members 82 which are provided on the cassette cover 72 along the opposite side edges thereof, and the guide 76 can be moved back and forth relative thereto. When the guide 76 is held in its operative position, paper sheet can be manually supplied under the guide of its top guide surface 84. The guide 76 has driven rollers 86, 86 rotatably mounted in its front portion and slightly raised relative to its top guide surface 84. In other words, the driven rollers 62, 62 are brought to their operative position to co-operate with the feed rollers 86, 86 for feeding a manually supplied paper sheet when the guide 76 is advanced to its regular operative position after the cassette 64 is loaded in the regular position.

This paper feed device further comprises a detecting system 88 including a paper detection switch 90. The switch 90 has an elastic pivotable actuator 92 provided on the underside of its casing, and it is opened and closed with the swinging action of the actuator 92. The actuator 92 extends down to a position below the shaft 60. The manual paper supply guide 76 is formed in its front portion with an actuator reception slot 94, which corresponds in position to the actuator 92 when the guide 76 is in the operative position. Likewise, the underlay plate 66 is formed in its front portion with a slot 96. In a cassette paper supply mode, the actuator 92 is in contact with the top of the paper sheet stack 68 while it is vertically aligned to the slot 96 via the paper. Thus, as soon as all paper sheets in the cassette are used up, the actuator 92 is allowed to swing into the slot 96, whereby the absence of paper is detected. In a manual paper supply mode, the actuator 92 is vertically aligned to the slot 94 of the manual paper supply guide. Thus, it is initially found in the slot 94, and is caused to swing up out of the slot 94 when a manually supplied paper sheet reaches the slot 94 and swing down into the slot 94 when the paper leaves the slot 94. In this way, the leading and trailing edges of the manually supplied paper sheet can be detected as they pass by the slot 94, that is, the manual paper supply mode itself can be detected.

When supplying paper with the paper feed device of the above construction in the cassette paper supply mode, the manual paper supply guide 76 is retreated to and held in its rear inoperative position or may be completely removed from the cassette 64. Then, the cassette 64 in this state, with a stack of paper sheets 68 accommodated in it, is set the paper feed section 56 in the regular position thereof. As a result, the top of the paper sheet stack 68 in the cassette paper supply section 74 is brought into urging contact with the feed rollers 62, 62, and also it is brought into urging contact with the actuator 92 to automatically actuate, for instance close, the detection switch 90. Thus, with a switch closure signal produced in this way, the "presence" of paper in the cassette 64 is detected. At this time the actuator 92 and slot 96 oppose each other.

Figure 5A:
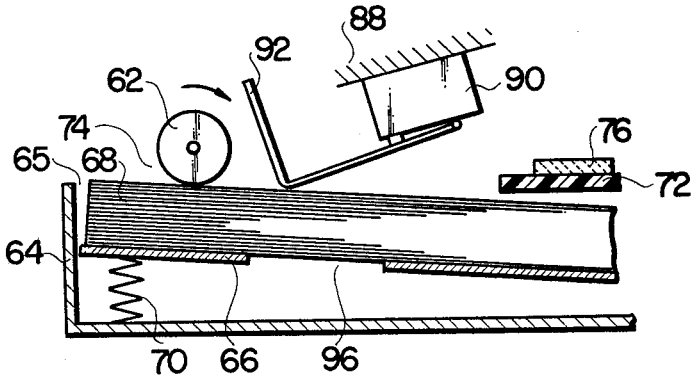
FIGS. 5A and 5B are fragmentary side sectional views respectively showing the paper feed device of FIG. 4 in different states of paper supply in a cassette paper supply mode.
Figure 5B:
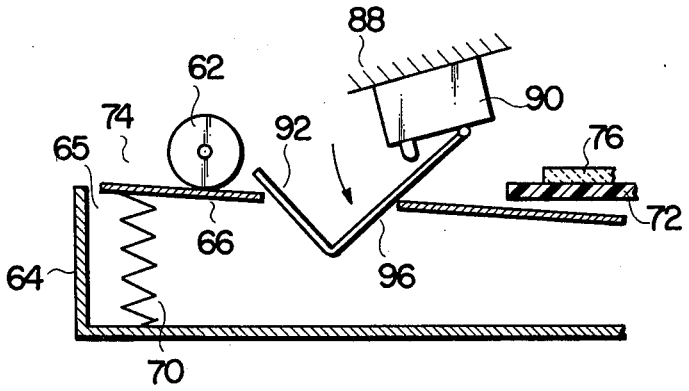

This state is shown in FIG. 4 and also in a fragmentary sectional view of FIG. 5A. In this state, as copying operation of duplicator (not shown) is caused to proceed, the feed rollers 62, 62 are rotated, whereby paper sheet stack 68 in the cassette 64 are supplied one after another in the cassette paper supply mode. When the paper sheet stack 68 in the cassette 64 are all used up, the upward urging force having been applied to the actuator 92 disappears. As a result, the actuator 92 swings down into the slot 96 as shown in FIG. 5B, whereby the detection switch 90 is opened. Thus, with a switch opening signal produced in this way, the "absence" of paper in the cassette 64 is detected.

When interrupting the cassette paper supply mode operation described above for manually supplying a paper sheet, the manual paper supply guide 76 having been held in the inoperative position is advanced to its operative position to conceal the cassette paper supply section, whereby the state of contact between the feed rollers 62, 62 and paper sheet stack top is switched over to the state of rolling contact between the feed rollers 62, 62 and driven rollers 86, 86. Concurrently with the establishment of this rolling contact state, the actuator 92 is allowed to swing down into the actuator reception slot 94, thus opening the detection switch 90. With the aforementioned advancement of the manual paper supply guide 76 to the operative position thereof, the state of the cassette paper supply mode is switched over to the manual paper supply mode, so that it is ready to make manual paper supply.

Figure 6:
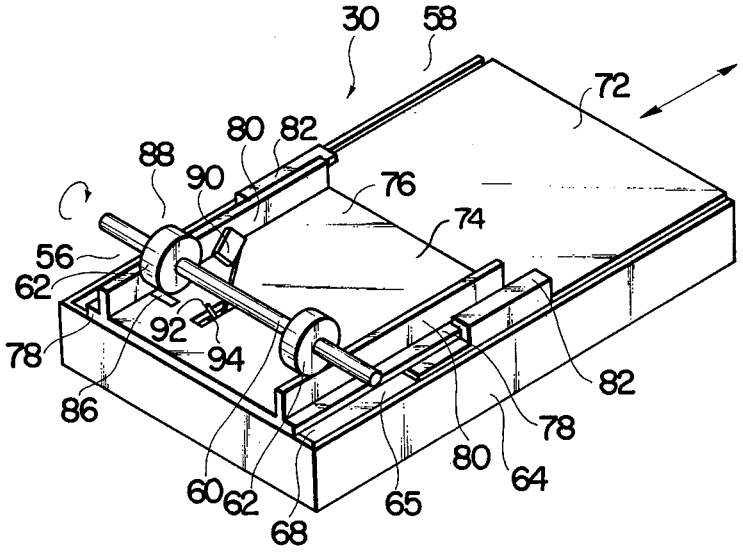
FIG. 6 is a perspective view showing the paper feed device of FIG. 4 in an initial state in a manual paper supply mode.
Figure 7A:
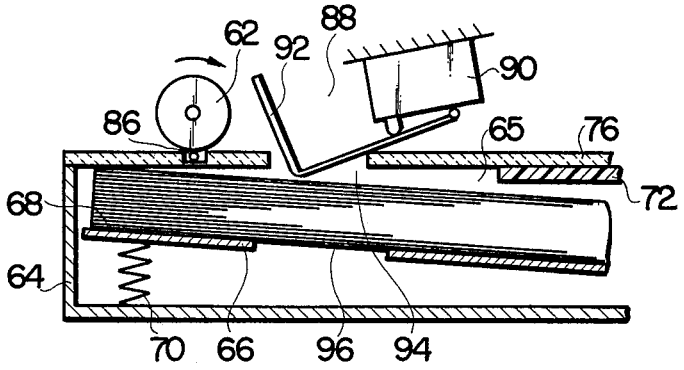
FIGS. 7A, 7B and 7C are fragmentary side sectional views respectively showing the paper feed device of FIG. 6 in different states of paper supply in the manual paper supply mode.
Figure 7B:
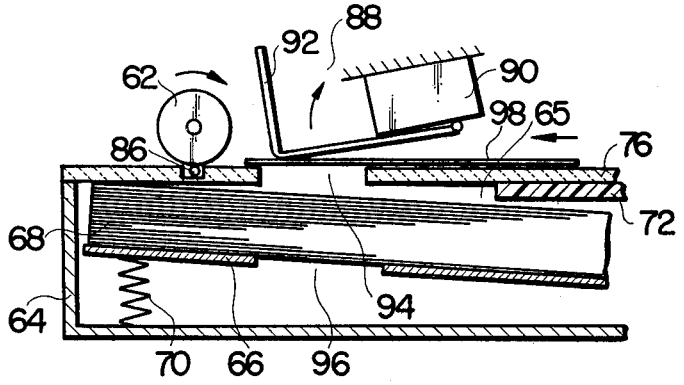
Figure 7C:
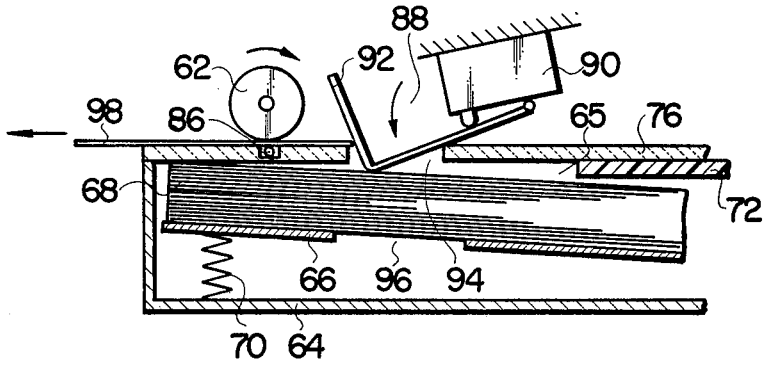

This state is shown in FIG. 6 and also in a fragmentary sectional view of FIG. 7A in detail. In this state, manual paper supply can be made by manually feeding a paper sheet 98 toward the feed rollers 62, 62 along the guide surface 84 of the manual paper supply guide 76 as shown in FIG. 7B.

It is detected from a switch actuation signal, for instance closure signal, produced from the detection switch 90 with the swing-up action of the actuator 92 caused by the leading edge of the manually fed paper sheet 98 which is successfully fed.

In this embodiment, the same signal as the absence-of-paper detection signal from the detection switch 90 is produced when the manual paper supply ready state is established. However, it is desirous in practice that the two signals are clearly distinguished from each other.

Figure 8A:
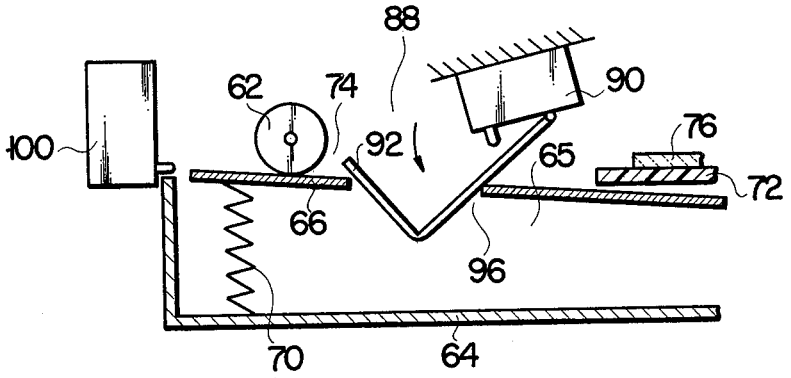
FIGS. 8A and 8B are fragmentary side sectional views showing a different embodiment of the paper feed device according to the invention, in which the absence of paper in a paper feed cassette and also a manual paper supply mode can again be detected by a single switch, in respectively different paper supply modes.
Figure 8B:
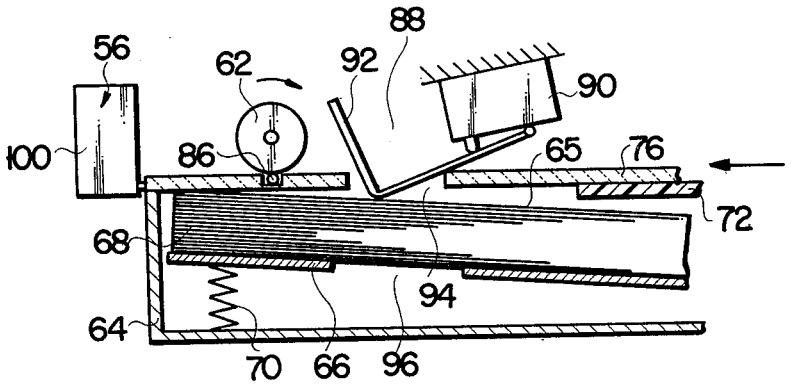

This is taken into considerations in an embodiment shown in FIGS. 8A and 8B. In this embodiment, a mode detection switch 100 is provided in paper feed section 56. The mode detection switch 100 is held in, for instance, the "off" state in the cassette paper supply mode and is turned on when the manual paper supply guide 76 is brought to the operative position for manual paper supply. With this arrangement, the absence-of-paper state occurring in the cassette paper supply mode and the establishment of the state ready for paper supply in the manual paper supply mode can be clearly distinguished from each other. In FIGS. 8A and 8B, like parts are designated by like reference numerals, and they are not described in any further.

Figure 9A:
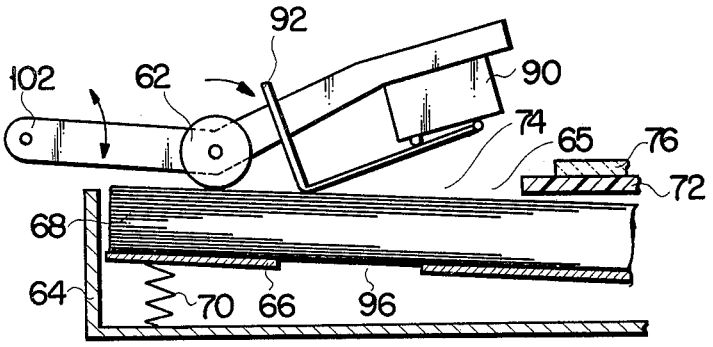
FIGS. 9A and 9B are fragmentary side sectional views showing a further embodiment of the paper feed device according to the invention, in which the absence of paper in a paper feed cassette and a manual paper supply mode can again be detected by a single switch, in respectively different paper supply modes.
Figure 9B:
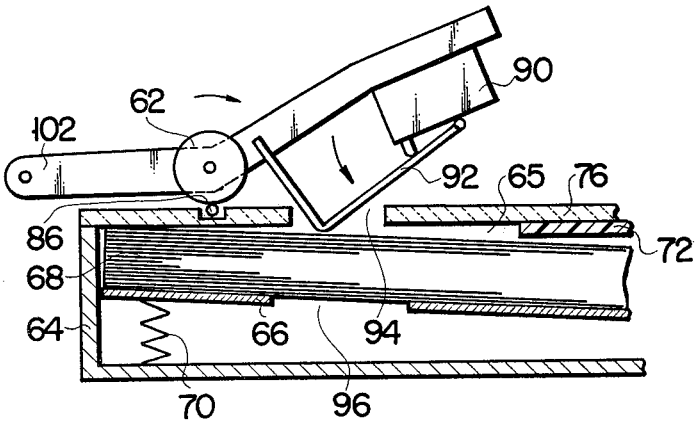

While in the preceding embodiments the detecting switch is provided in a fixed position, it may be provided in a manner as shown in FIGS. 9A and 9B as well. In this arrangement, paper detection switch 90 is installed on a pivotable bracket 102, by which feed rollers 62, 62 are supported for vertical rocking. With the paper detection switch 90 pivotably supported in this way, the same effects as in the preceding embodiments can also be obtained. Again in FIGS. 9A and 9B, like parts are designated by like reference numerals, and their description is omitted.

Further, while in the preceding embodiments the cassette paper supply and manual paper supply modes are switched merely with the advancement or retreat of the manual paper supply guide, it is possible to arrange in a system where paper feeder cassettes are vertically moved that the switching of modes is effected with a combination of the advancement or retreat of the manual paper supply guide and vertical movement of paper feed cassette.

Figure 10:
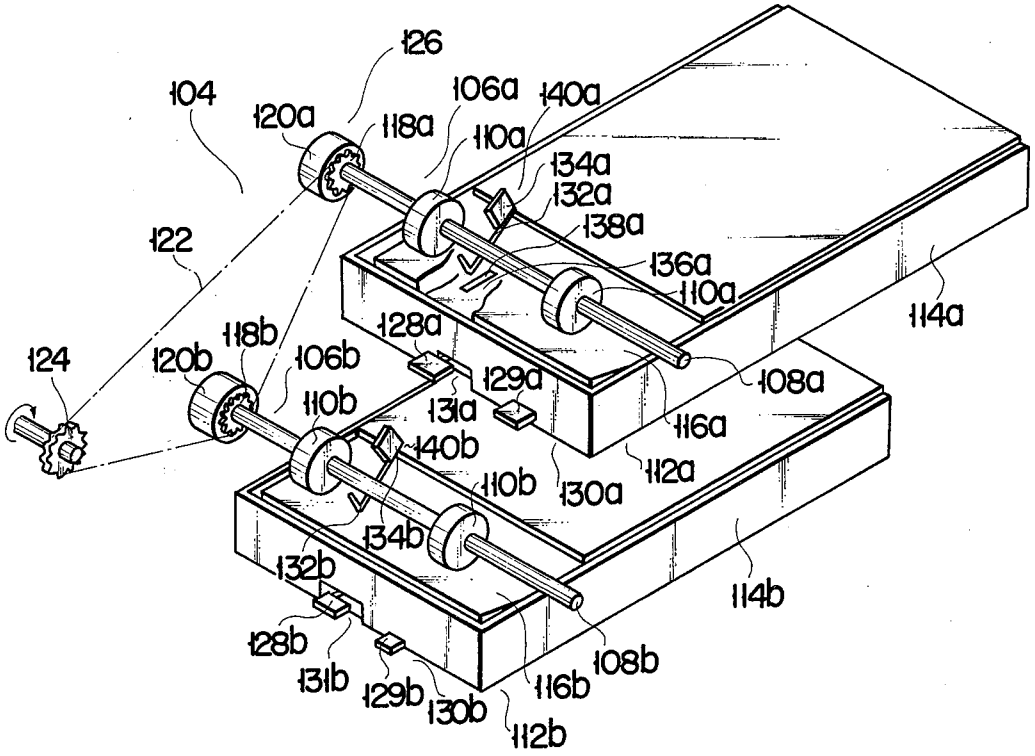
FIG. 10 is a perspective view showing a further embodiment of the paper feed device according to the invention, which, when used with a plurality of paper feed cassettes accommodating paper of the same size, can automatically switch cassettes one over to another when the previous one has run out of paper sheets to thereby permit successive paper supply without unnecessary interruption.

FIG. 10 shows a further embodiment. Referring to the Figure, designated at 104 is a paper feed system comprising a plurality of paper feed mechanisms, which are arranged one above another. More particularly, it is a two-stage system comprising two paper feed mechanisms 106*a* and 106*b*. These paper feed mechanisms 106*a* and 106*b* have the same construction, so like parts in these systems are designated by like reference numerals except for that a subscript a is added to the reference numerals of the parts in the mechanism 106*a* and a subscript b in the mechanism 106*b*. Also, of these mechanisms, only the mechanism 106*a* will be described. Designated at 108*a* is a driven shaft provided for the upper stage paper feed mechanism 106*a* and carrying two feed rollers 110*a* made of rubber and axially spaced apart. A paper feed section 112*a* is defined in a space beneath the paper feed rollers 110*a*, 110*a*, and a paper feed cassette 114*a* is detachably loaded in the paper feed section 112*a* for supplying paper sheets 116*a* stacked in the cassette 114*a* one after another with feed rollers 110*a*, 110*a*.

A drive section for the two-stage paper feed system 104 of this construction includes electromagnetic clutches 108*a* and 108*b* respectively mounted on one end of the driven shafts 108*a* and individually having respective input gears 118*a* and 118*b* and a drive gear 124 coupled to thereto via an endless chain 122 and driven by a drive mechanism section. The paper feed mechanisms 106*a* and 106*b* are selectively operated by drive force transmitted from the drive gear 124 through the chain 122 to the electromagnetic clutch 120*a* or 120*b*. The individual electromagnetic clutches 120*a* and 120*b* are of the type responsive to an input signal, that is, the input gears 118*a* and 118*b* which are the input side are coupled to the respective output side driven shafts 108*a* and 108*b* according to an input signal. In other words, these electromagnetic clutches 120*a* and 120*b* constitute a paper feed mechanism switching means 126 for selectively operating either paper feed mechanism 106*a* or 106*b* as desired.

The paper feed sections 112*a* and 112*b* of the paper feed system 104 having the above construction are each provided with a paper size detecting means and an absence-of-paper detecting means.

The paper size detecting means 130*a* for the section 112*a* includes two detection switches 128*a* and 129*b* provided at the front of the section and laterally spaced apart a predetermined distance. The size of the paper sheets accommodated in the paper feed cassette 114*a* loaded in the paper feed section 112*a* is detected depending upon three of four combinations of the "on" and "off" signals produced from the detection switches 128*a* and 129*a*. The paper feed cassette 114*a* is provided or not provided in its front portion corresponding to each of the detection switches 128*a* and 129*a* with a notch 131*a* in dependence upon the size of the paper sheets 116*a* accommodated in it, so that the switches 128*a* and 129*a* may be selectively operated at the time of its loading. With this paper size detecting means 130*a* three different paper sheet sizes, for instance A4, B4 and B5 sizes, can be detected.

The paper size detecting means for the paper feed section 112*b* has the same construction as the means 130*a* described above, so like parts are designated by like reference numerals except for that a subscript b is added in lieu of the subscript a without making further description of the construction.

The absence-of-paper detecting means 140*a* for the paper feed section 112 includes a detection switch 134*a*, which is provided above the front end of the paper feed section 112*a* and has an actuator 132*a* downwardly extending from its casing into the section toward the front thereof. The detection switch 134*a* is of a type producing an "on" or "off" signal with the action of the actuator 132*a*, for instance producing the "on" signal when the actuator 132*a* is upwardly urged and producing the "off" signal when the actuator 132*a* is released, and the absence-of-paper is detected on the basis of these "on" and "off" signals. More particularly, the paper feed cassette 114*a* accommodates an underlay plate 136*a*, on which cassette paper sheets 116*a* are stacked, and a front portion of which is upwardly spring biased. The underlay plate 136*a* is formed in its portion corresponding to the actuator 132*a* with an actuator reception slot 138*a*, which is usually closed by the paper sheet stack 116*a*. That is, when the cassette 114*a* with paper sheet stack 116*a* therein is loaded, the actuator 132*a* is raised by the paper sheet stack to produce an "on" signal, and when it becomes that no paper is present under the actuator 132*a* the actuator 132*a* is released from the urged state and falls into the actuator reception slot 138*a* to produce an "off" signal. In this way, the absence-of-paper is detected by the absence-of-paper detecting means 140*a* from these "on" and "off" signals.

The absence-of-paper detecting means for the paper feed section 112*b* is the same as the absence-of-paper detecting means 140*a* described above, so like parts are designated by like reference numerals except for that a subscript b is added in lieu of the subscript a without making further description of the construction.

Figure 11:
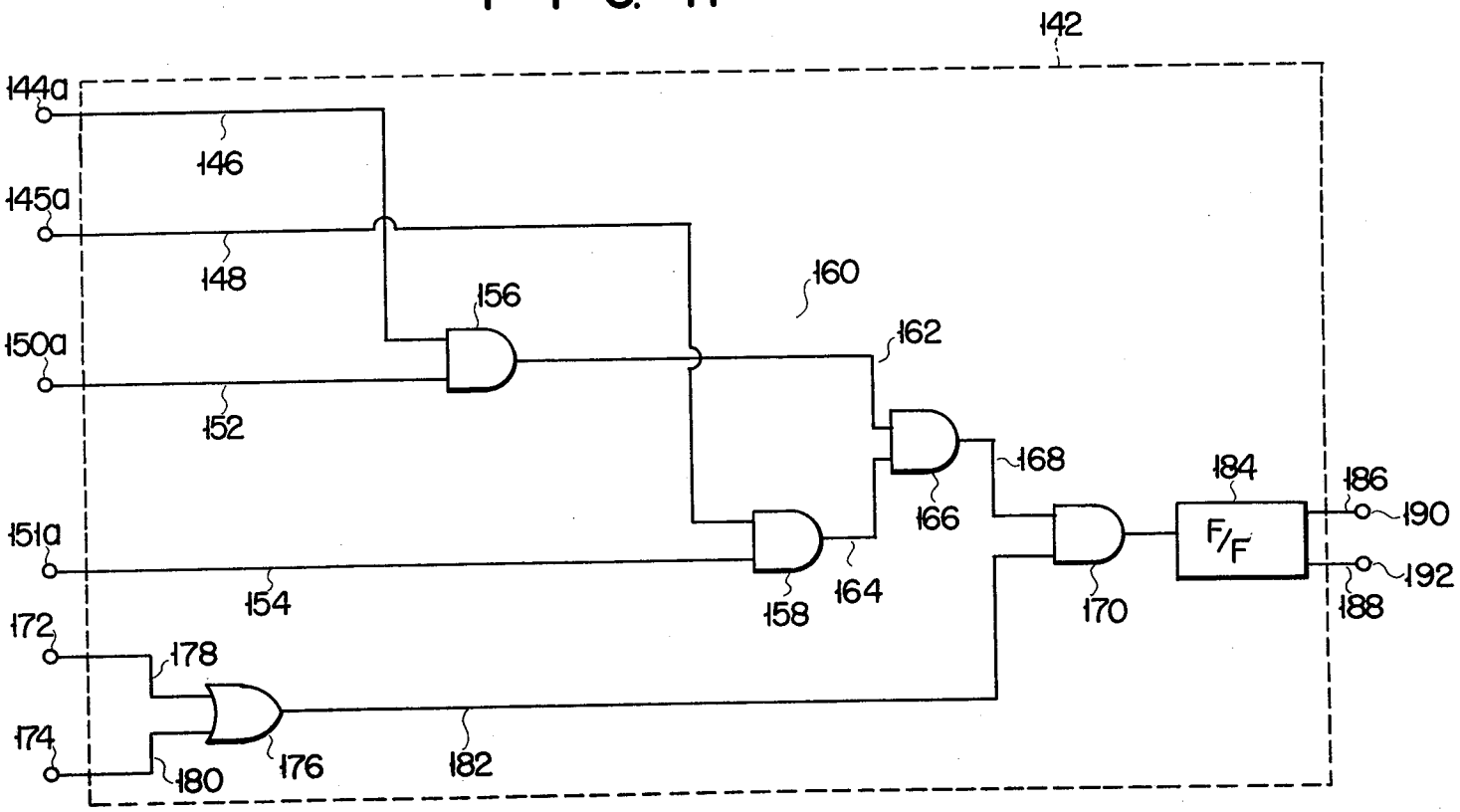
FIG. 11 shows a detailed circuit diagram of a control circuit used in the embodiment of FIG. 10.

FIG. 11 shows a control circuit 142 for controlling the paper feed device of the above construction according to the output signals of the individual detecting means. In the Figure, designated at 144*a* and 145*a* are input terminals, to which the outputs from the detection switches 128*a* and 129*a* of the paper size detecting system are coupled respectively. Input lines 146 and 148 are connected to the respective input terminals 144*a* and 145*a*.

Designated at 150*a* and 151*a* are input terminals, to which the outputs from the detection switches 128*b* and 129*b* of the paper size detecting system are coupled respectively. Input lines 152 and 154 are connected to the respective input termminals 150*a* and 151*a*. The lines 146 and 152 are connected to an AND gate 156, and the lines 148 and 154 are connected to an AND gate 158.

The component parts of the circuit described so far constitute a detection system 160 for detecting that the paper sheets 116*a* and 116*b* in the paper feed cassettes 114*a* and 114*b* loaded in the upper and lower paper feed sections 112*a* and 112*b* are of the same size.

The output terminals of the AND gates 156 and 158 are connected through respective detection signal output lines 162 and 164 to an AND gate 166, and a paper size coincidence signal is produced from the AND gate 166 when the paper sheet sizes of the upper and lower stages coincide. The output side of the AND gate 166 is connected through an output line 168 to one of two input terminals of an AND gate 170.

Designated at 172 and 174 are input terminals, to which the outputs from the upper and lower stage detection switches 134*a* and 134*b* of the absence-of-paper detecting system described above are coupled. These input terminals 172 and 174 are connected through respective lines 178 and 180 to an OR gate 176, the output side of which is connected through a line 182 to the other input terminal of the AND gate 170. Thus, when it becomes that no paper sheet 116*a* or 116*b* is present in the cassette 114*a* or 114*b*, an absence-of-paper signal is coupled to the AND gate 170.

The AND gate 170 supplies an output signal to a flip-flop 184 when and only when both the paper size coincidence signal and absence-of-paper signal are coupled to it.

The output side of the flip-flop 184 is connected through output lines 186 and 188 to input terminals of the respective electromagnetic clutches 120*a* and 120*b* mentioned before. Thus, according to its input signal the flip-flop 184 produces control outputs to switch the electromagnetic clutches 120*a* and 120*b*, that is, stop the operation of the paper feed mechanism 106*a* or 106*b* on the side from which the absence-of-paper signal is produced and start the operation of the other paper feed mechanism in which there are paper sheets of the same size, thus permitting successive supply of the same size paper.

Now, the operation of the paper feed device of the above construction in detail.

The paper feed cassettes 114*a* and 114*b*, which indicate a given paper size, for instance A4 size, with the respective notches 131*a* and 131*b* and individually accommodate paper sheet stacks 116*a* and 116*b* of the indicated paper size, are prepared. The cassette 114*a* is loaded in the upper stage paper feed section 112*a*, and the cassette 112*a* is loaded in the lower paper feed section 114*b*. At this time, the control circuit 142 gives no action since both the cassettes 114*a* and 114*b* accommodate the respective paper sheets 116*a* and 116*b*.

By subsequently causing copying operation of duplicator (not shown) in conformity to the given paper sheet size, a drive mechanism section (not shown) is rendered operative, and the electromagnetic clutch 120*a* of the upper stage, for instance, is energized to couple the drive section for power transmission to the associated paper feed mechanism 106*a*. Thus, the rotation of the drive gear 124 is transmitted through the chain 122 and input gear 118*a* to the driven shaft 108*a* to cause rotation of the paper feed rollers 110*a*, 110*a* in contact with the top of the paper sheet stack 116. With the rotation of the rollers 110*a*, 110*a* the paper sheets 116*a* are supplied one after another from the cassette 114*a* forward for a copying process (not shown). In this way, copying of the given paper sheet size is effected.

In the prior art, when the cassette 114*a* has run out of paper sheets 116*a*, the paper supply operation of the paper feed device is stopped even if there are other paper feed cassettes with paper sheets of the same size therein. This has been inconvenient in case of continuous paper supply.

According to the invention, when the paper sheets 116*a* in the cassette 114*a* are all used up, successive supply of the same size paper is made from the other paper feed cassette. More particularly, when it becomes that no paper sheet 116*a* is present in the cassette 114*a*, the actuator 132*a* of the detection switch 134*a* swings into the actuator reception slot 138*a*, so that the "off" signal is coupled from the switch 134*a* to the input terminal 172, and thence through the OR gate 176 to the AND gate 170.

Meanwhile, since the loading of the cassettes 114*a* and 114*b* in the respective paper feed sections 112*a* and 112*b*, the detection switches 128*a*, 129*a*, 128*b* and 129*b* have been held in their respective states determined by whether the corresponding portions of the cassette are provided with the notch 131*a*. For example, the left side switch 128*a* in the section 112*a* has been held "off" and providing the "off" signal to the input terminal 144*a* while the right side switch 129*a* has been held "on" by the front of the cassette 114*a* and providing the "on" signal to the input terminal 145*a*. Likewise, in the section 112*b* the left side switch 128*b* has been held "off" and providing the "off" signal to the input terminal 150*a* while the right side switch 129*b* has been held "on" by the front of the cassette 114*b* and providing the "on" signal to the input terminal 151*a*. Thus, with the coincidence outputs from the AND gates 156 and 158 the AND gate 166 has been providing the paper size coincidence signal to the AND gate 170.

When the AND gate 170 which has been receiving this paper size coincidence signal also receives the aforementioned absence-of-paper signal, it produces the output signal to actuate the flip-flop 184. The flip-flop 184 thus produces control outputs to automatically de-energize the electromagnetic clutch 120*a* so as to render the paper feed mechanism 106*a* inoperative and, instead, energize the other electromagnetic clutch 120*b* so as to couple the drive section for power transmission to the paper feed mechanism 106*b*, thus permitting successive paper supply from the paper feed mechanism 106*b* in lieu of the mechanism 106*a*. As has been shown, when the cassette 114*a* uses up of paper, the paper feed mechanism 106*a* is switched over to the other mechanism 106*b* to thereby permit successive cassette paper supply without any undesired interruption so long as the cassette 114*b* contains paper sheets 116*b* of the same size as before.

Thus, it is possible to save time that may otherwise required for changing the cassettes 114*a* and 114*b*. Also, successive paper supply can be assured even in case if the copying operation is left unattended when the cassette having been in uses up of paper.

While in the above description the paper feed cassettes which contain A4 size paper sheets have been concerned with, the same effects can of course be obtained with cassettes containing paper sheets of other sizes such as B4 and B5 sizes.

Figure 12:
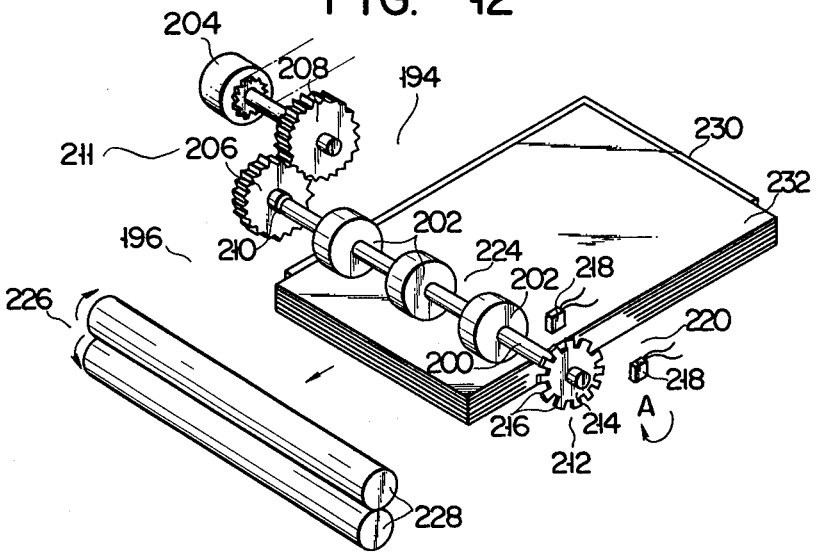
FIG. 12 is a perspective view showing another embodiment of the paper feed device according to the invention, which can detect the trailing edge of paper sheet.

FIG. 12 is a perspective view of a paper feed device which can detect the trailing edge of paper sheet. This paper feed mechanism 194 comprises a paper feed mechanism 196 and a paper feed cassette 230. The paper feed mechanism 196 includes a paper feed roller unit 204, which is constituted by a driven shaft 200 carrying three rollers 202 made of rubber, for instance, and axially spaced apart. The drive section for the paper feed roller unit 204 includes a driven gear 206 provided at one end of the driven shaft 200 and a drive gear 208 which is driven through an electromagnetic clutch 204 and meshed with the driven gear 206. The rotation of the drive gear 208 is thus transmitted through the driven gear 206 to the paper feed roller unit 204 to operate the unit. A one-way clutch 210 is provided between the driven gear 206 and driven shaft 200. This one-way clutch is adapted to transmit the rotation of the driven gear 206 only in the direction of arrow A, in which the rollers 202 are rotated, that is, the rollers 202 are allowed to freely rotate only in the direction of arrow A.

A drive control means 211 consists of the electromagnetic clutch 204, driven gear 206 and one-way clutch 210.

The driven shaft 200 is provided at the other end with a detecting means 212 for detecting the trailing edge of paper sheet.

The detecting means 212 includes a disc 214 which is secured to the driven shaft 200 at one end thereof and provided with a number of uniformly spaced apart peripheral notches 216. A pair of photoelectric cells 218, 218 are provided on the opposite sides of the disc 214 such that they oppose each other through the notches, and constitute a pulse generator 220. This pulse generator 220 serves as a contact-free detector for detecting the rotation of the paper feed rollers 202 through the detection and non-detection of the notches 216. The detecting means 212 further includes a detecting circuit 222 (FIG. 16) connected to the pulse generator 220. The detecting circuit 222 will be described later in detail.

A paper transport means 226 is provided ahead of the paper feed roller unit 224, which is provided with the detecting means 212 and drive system as described above. The paper transport means 226 may be constituted by transport roller section provided on duplicator (not shown) or electrostatic transport section of duplicator photosensitive drum (not shown). In the instant embodiment, it is constituted by a pair of transport rollers 228, 228 in rolling contact with each other. Copying paper sheets 232 fed out one after another by the aforementioned paper feed roller unit 224 can be successively transported to, for instance, a transfer section by the paper transport means. The drive system for the paper feed roller unit 224 is adapted to be turned off a predetermined period of time after each paper sheet 232 is pinched by the paper transport means 226.

The detecting circuit 222 mentioned above will now be described with reference to FIG. 16.

The output side of the unit of photoelectric cells 218 mentioned above is connected to an integrator 234, the output side of which is in turn connected through an inverter 236 to an AND gate 238. Designated at 240 is a timer, the output side of which is connected through a delay circuit 242 to the integrator 234 and also connected directly to the AND gate 238. The AND gate 238 produces an output signal depending upon whether there is an overflow signal coupled to it within a predetermined period of time represented by the integration information based upon the output signal from the photoelectric cell. The passage of the paper sheet 232 by the paper feed roller unit 224 is detected with the appearance of the output signal from the AND gate 238.

Figure 13:
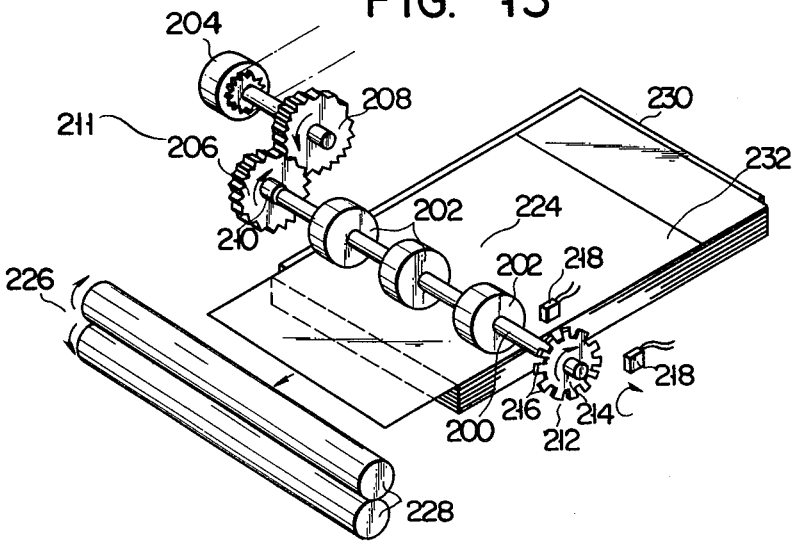
FIGS. 13 through 15 are perspective views showing the embodiment of FIG. 12 in respectively different states of paper supply.
Figure 14:
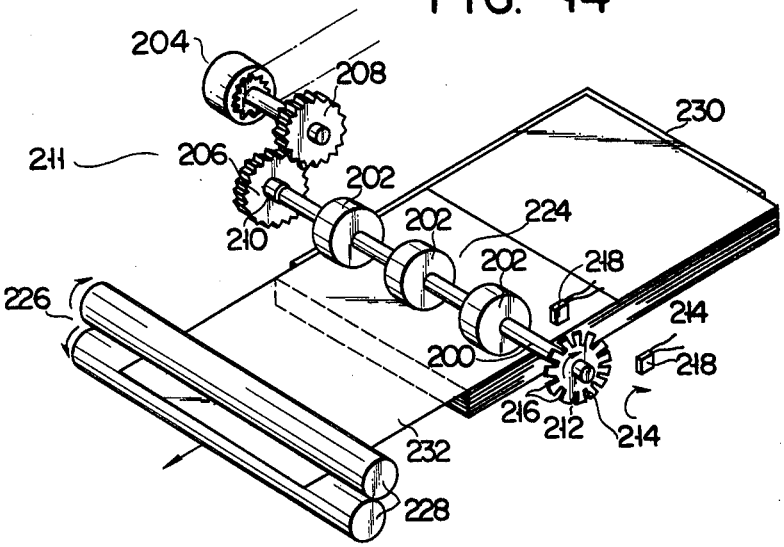

For cassette paper supply with the paper feed device 194 of the above construction, the paper feed cassette 230 accommodating the paper sheet stack 232 is loaded in a predetermined position as shown in FIG. 12. Then, an operating section of duplicator (not shown) is operated. By this operation, the external drive section is turned on to cause rotation of the drive gear 208. This rotation is transmitted through the driven gear 206 and one-way clutch 210 to the driven shaft 200 to drive the paper feed rollers 202, whereby the copying paper sheets 232 in the cassette 230 are fed out forward, i.e., toward the paper transport rollers 228, 228, one after another from the top as shown in FIG. 13. When each paper sheet 232 is pinched by the paper transport rollers 228, 228, as shown in FIG. 14 it is transported thereby. After the lapse of a predetermined period of time that is required for successive paper supply from the establishment of the paper pinching state of the paper transport means, the drive control means 211 for the paper feed rollers 224 is turned off. Thereafter, the paper sheet 232 is successively transported forward by the transport rollers 228, 228 to reach photosensitive drum, for instance. Meanwhile, the rollers 202 are permitted by the one-way clutch 210 to be driven by the paper sheet 232 being transported in contact with them.

Figure 17A:
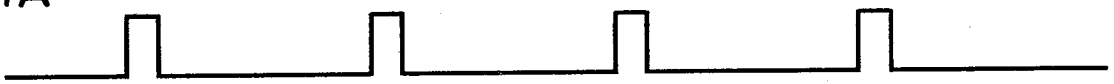
FIGS. 17A through 17E form a time chart for waveforms of output signals from various parts of the detecting circuit of FIG. 16, with FIG. 17A showing the waveform of a timer output signal, FIG. 17B showing that of a delay circuit output signal, FIG. 17C showing that of an integrator output signal, FIG. 17D showing that of an inverter output signal, and FIG. 17E showing that of an AND circuit output.
Figure 17B:
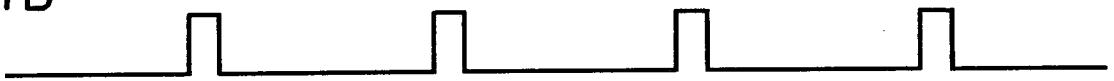
Figure 17C:
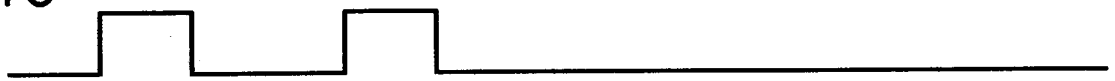
Figure 17D:
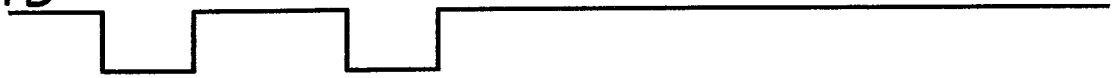

In the detecting unit 212, the disc 214 has been rotating from the start of the paper supply, and the photoelectric cells 218, 218 have been providing a pulse signal based upon the detection and non-detection of notches 216 to the integrator 234. Also, the timer 240 has been providing a clock pulse signal as shown in FIG. 17A to the delay circuit 242 and AND circuit 238, and the delay circuit 242 has been providing clock pulses as shown in FIG. 17B as a reset signal to the integrator 234. The integrator 234 integrates its pulse signal input for a predetermined period of time. During the rotation of the disc 214, the output of the integrator is supplied as an overflow signal as shown in FIG. 17C to the inverter 236, which produces an inversion output as shown in FIG. 17D.

Figure 15:
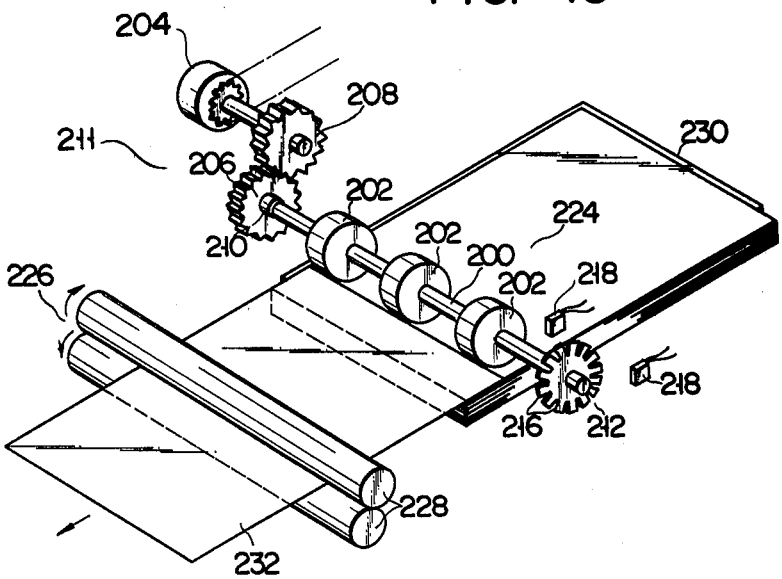

When the trailing edge of paper sheet 232 clears the rollers 202, as shown in FIG. 15, the rollers cease to be rotated, so that the pulse signal output having been produced from the photoelectric cells 218, 218 from the start of the paper supply vanishes.

Figure 17E:
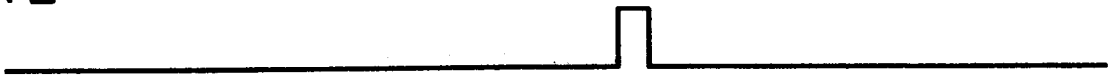

With the vanishment of this pulse signal output, i.e., the input to the detecting unit 212, the integrator 234 no longer produces any overflow signal, and a detection signal is coupled from the inverter 236 to the AND gate 238. Thus, the trailing edge of the paper sheet 232 is detected with the appearance of signal as shown in FIG. 17E produced from the AND gate 238, which represents the stoppage of the rollers 202, i.e., the passage of the trailing edge of paper sheet by the rollers 202.

It will be appreciated that the trailing edge of the paper sheet 232 can be reliably detected irrespective of the paper sheet size without any possibility of obstructing the paper transport through the transport path at all. In addition, the possibility of jamming can be eliminated. Further, since the trailing edge of the paper sheet 232 is detected from the stopping of the paper feed rollers 224, the length of paper sheet transport path required for detection can be minimized, which is useful for as early detection of the trailing end as possible and very useful for the small-size duplicator.

While the above embodiment has been designed for cassette paper supply with a paper feed cassette accommodating a stack of paper sheets, the same effects may be obtained in case of manually supplying paper sheets one after another.

Also, while the above embodiment has used as the paper sheet trailing edge detecting means a pulse generator constituted by a combination of a disc with notches and photoelectric cells, it is also possible to use a pulse generator including an electromagnetic rotary sensor. As a further alternative, it is possible to provide the driven shaft with an electricity generator as a detecting element for detecting the stoppage of the paper feed rollers through the comparison of the detector output and a threshold value.

Figure 18:
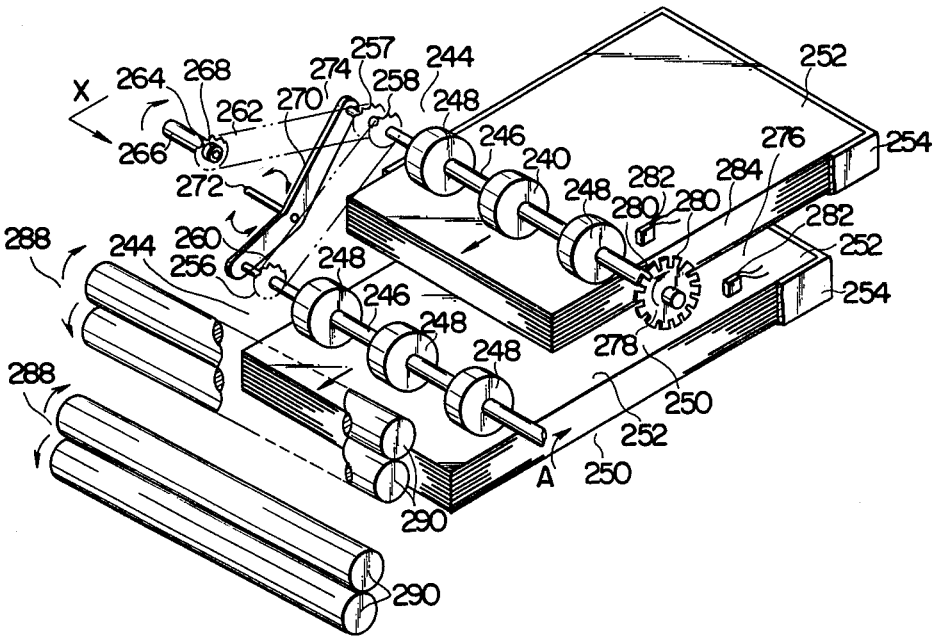
FIG. 18 is a perspective view showing still another embodiment of the paper supply device according to the invention, which can detect the trailing edge of paper sheet supplied from a plurality of paper feed cassettes with a single detecting means.

FIG. 18 shows a still another embodiment, which is designed to detect the trailing edge of paper sheet from one of paper feed cassettes in a plurality of stages using a single detecting means.

Referring to the Figure, is a paper feed device having there shown two paper feed stages. These stages are materially the same in construction, so like parts are designated by like reference numerals. A paper feed roller unit 244 of each stage is provided in a duplicator frame, for instance, and includes a driven shaft 246 carrying three paper feed rollers 248 mounted thereon and spaced apart from one another. A space below the paper feed rollers 248 of the unit 244 constitutes a cassette mounting section 256.

The paper feed roller units 244 for the individual two stages, having the above construction, constitute a two-stage paper feed system. A paper feed cassette 254 accommodating a paper sheet stack 252 is detachably loaded in each cassette mounting section 256, 256 under the associated paper feed roller units 244, 244.

Figure 19:
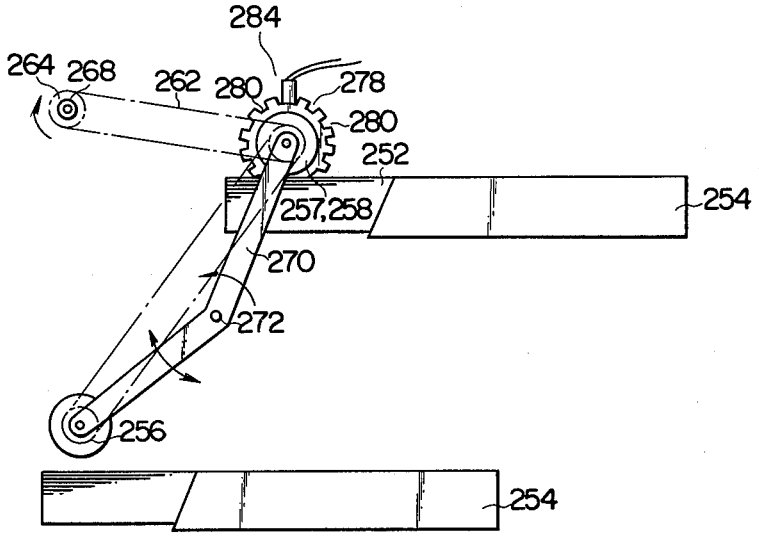
FIG. 19 is an enlarged-scale side view from a plane of arrow X in the perspective view of FIG. 18.

FIG. 19 shows a selective drive force transmission system 274 for the paper feed roller units 244 more clearly. Designated at 256 is a driven sprocket provided at one end of the driven shaft 246 in the lower stage, and at 257 and 258 driven sprockets provided side by side at the corresponding end of the driven shaft 246 in the upper stage. Of these driven sprockets 256 through 258, the sprockets 256 and 258 are coupled together by a chain 260, and the sprocket 257 is coupled via a chain 262 to a drive sprocket 264 which is driven from an external drive section (not shown). The rotation of the drive sprocket 264 is thus transmitted through the chain 262 and driven sprocket 257 to the driven shaft 256 for the upper stage and thence through the driven sprocket 258, chain 260 and driven sprocket 256 to the driven shaft 246 for the lower stage, whereby the individual paper feed roller units 244 are operated. The drive sprocket 264 is mounted on a drive shaft 266 of this drive system, and a one-way clutch 268 is provided between the drive shaft 266 and drive sprocket 264 and functions to transmit the rotation of the drive sprocket 264 only in the direction of arrow A, in which the rollers 248 are rotated, that is, allows the rollers 247 to rotate freely in the direction of arrow A. The individual paper feed roller units 244, 244 are coupled together by an arm 270 which is tied to one end of each of the driven shafts 246, 246. The center of the arm 270 is pivotally mounted on a rotation shaft 272. The rollers 248 of the individual paper feed roller units 244, 244 are thus selectively brought into contact with the paper 252 in the respective paper feed cassettes 254, 254 with swinging action of the arm 270, and paper sheets 252 in the selected paper feed cassette 254 are fed out one after another.

The driven shaft 246 for the upper stage is provided at its other end with a paper trailing edge detecting means 276. The detecting means 276 includes a disc 278 secured to the end of the driven shaft 246 and provided with a number of uniformly spaced apart peripheral notches 280. A pair of photoelectric cells 282, 282 are provided on the opposite sides of the disc 246 such that they oppose each other through the notches 280, and constitute a pulse generator 284. The detecting means 276 also includes a detecting circuit connected to the pulse generator 284. The detecting circuit has the same construction as that shown in FIG. 16, so it is not described here.

Paper transport means 288, 288 are provided ahead of each of the paper feed roller units 244, 244, which are driven by the same drive system. The paper transport means 288, 288 may be constituted by transport roller section provided on duplicator (not shown) or electrostatic transport section of duplicator photosensitive drum (not shown). In this embodiment, each of these means is constituted by a pair of transport rollers 290, 290 in rolling contact with each other. Paper sheets 252 fed out one after another by the paper feed roller unit 244 can be successively transported to, for instance, a transfer section by the paper transport means 288.

The drive system for the paper feed roller units 290, 290 is adapted to be turned off a predetermined period of time after a paper sheet 252 is pinched by either paper transport means 288, 288.

For cassette paper supply with the paper feed device of the above construction, the individual paper feed cassettes 254, 254 accommodating respective paper sheet stacks, for instance of different paper sizes, are loaded as shown in FIG. 18 in proper positions in the respective cassette loading sections 256, 256. Then, copying operation is brought about by selecting the paper size in an operating section of duplicator (not shown). At this time, the external drive section is rendered operative to turn the rotation shaft 272 together with the arm 270, thus engaging the rollers 248 for the upper stage, for instance, with the top of the paper sheet stack 252 and bringing the rollers 248, 248 for the lower stage to a position out of contact with the paper sheet stack top. In this way, a state ready for paper supply from the cassette 254 in the upper stage is established. Coincidentally, power from the external drive section is transmitted through the drive sprocket 264, that is, the rotation of the shaft 266 is transmitted through the drive sprocket 264, one-way clutch 268, chain 262 to the driven sprocket 257 and thence through the driven sprocket 258 and chain 262 to the driven sprocket 256, thus causing rotation of the rollers 248 in the individual stages. As a result, paper sheets 252 in the upper stage cassette 254 are fed out one after another by the rollers 248 of this stage toward the transport rollers 290, 290 thereof. When the leading edge of each paper sheet 252 is pinched by the transport rollers 290, 290, it is transported thereby. After the lapse of a predetermined period of time required for successive paper supply from the establishment of the paper pinching state of the paper transport means, the drive system for the paper feed roller units 244, 244 is rendered inoperative. Thereafter, the paper sheet 252 is successively transported forward by the transport rollers 290, 290 to reach photosensitive drum, for instance. Meanwhile, the rollers 248 of the upper stage are permitted by the one-way clutch 268 to be driven by the paper sheet 252 being transported in contact with them.

Figure 16:
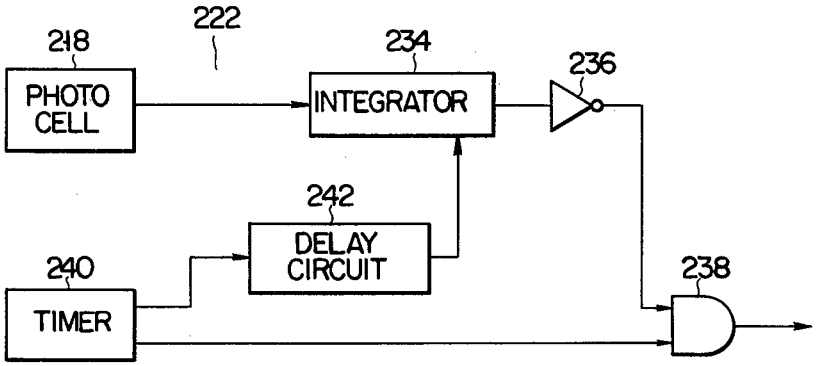
FIG. 16 is a view showing the detailed circuit construction of a detecting circuit used in the embodiment of FIG. 12.

In the detecting unit 276, the disc 278 has been rotating from the start of the paper supply, and the photoelectric cells 282, 282 have been providing a pulse signal based upon the detection and non-detection of notches 280 to the integrator 234 shown in FIG. 16. Also, the timer 240 has been providing a clock pulse signal as shown in FIG. 17A to the delay circuit 242 and AND gate 238, and the delay circuit 242 has been providing clock pulses as shown in FIG. 17B as a reset signal to the integrator 234. The integrator 234 integrates its pulse signal for a predetermined period of time. During the rotation of the disc 278, the output of the integrator is supplied as an overflow signal as shown in FIG. 17C to the inverter 236, which produces an inversion output as shown in FIG. 17D.

When the trailing edge of the paper sheet 252 clears the rollers 248 in the upper stage, these rollers, and hence the disc 278, ceases to be rotated, so that the pulse signal output having been produced from the photoelectric cells 282, 282 from the start of paper supply vanishes.

With the vanishment of this pulse signal, i.e., the input to the detecting unit, the integrator 234 no longer produces any overflow signal, and a detection signal is coupled from the inverter 236 to the AND gate 238. Thus, the trailing edge of the paper sheet 252 is detected with the appearance of signal as shown in FIG. 17E produced from the AND gate 238.

For supplying paper of a different paper size by changing paper feed cassettes, for instance to the one 254 in the lower stage, the aforementioned operating section is operated to select the different paper size, whereby the rotation shaft 272 is turned together with the arm 270 to bring the upper stage rollers 248 out of contact with the top of the paper sheet stack 252 and bring the lower stage rollers 248 into contact with the paper sheet stack top. Thus, a state ready for paper supply from the lower stage paper feed cassette 254 is established. Then, the rollers 248 in the individual stages are rotated with power coupled through the drive sprocket 264, one-way clutch 268, chain 262 to the driven sprocket 257 and thence through the driven sprocket 258 and chain 262 to the driven sprocket 256. As a result, paper sheets 252 in the lower stage cassette 254 are fed out one after another by the rollers 248 of this stage toward the transport rollers 290, 290 thereof. Like the above-described case of paper supply from the upper stage paper feed cassette 254, when the leading edge of each paper sheet 252 is pinched by the transport rollers 290, 290 it is transported thereby, and after the lapse of a predetermined period of time from the establishment of the paper pinching state the drive system for the paper feed roller units 244, 244 is rendered inoperative. Thereafter, the paper sheet 252 is continuously transported forward by the transport rollers 290, 290 to reach photosensitive drum, for instance. Meanwhile, the rollers 252 of this state are permitted by the one-way clutch 268 to be driven by the paper sheet 252 being transported in contact with them.

Like the case with the upper stage cassette 254, in the detecting unit 276 has been operative since the start of paper supply, and the AND gate 238 shown in FIG. 16 has been receiving the inversion output as shown in FIG. 17D.

When the trailing edge of the paper sheet 252 clears the rollers 248 in this stage, these rollers and disc 278 ceases to be rotated, so that the pulse signal output having been produced from the photoelectric cells 282, 282 vanishes. As a result, the integrator 234 ceases to provide overflow signal, and a detection signal is coupled from the inverter 236 to the AND gate 238. Thus, the trailing edge of the paper sheet 252 is detected with the appearance of signal as shown in FIG. 17E, which represents the stoppage of the rollers 248, i.e., the passage of the trailing edge of the paper sheet 252 by the rollers 248.

It will be appreciated that the trailing end of paper from one of a plurality of, for instance two, paper feed cassettes 254, 254 is detected by the same paper trailing edge detecting means. Thus, it is possible to simplify the detecting system for a duplicator for use with a plurality of paper feed cassettes 254, 254.

While in the above embodiment a pulse generator constituted by a combination of a disc with notches and photoelectric cells has been used as a paper sheet trailing edge detecting means, like the embodiment shown in FIG. 12, it is possible to use a pulse generator including an electromagnetic rotary sensor as well and, as a further alternative, it is possible to provide the driven shaft with an electricity generator as a detecting element for detecting the stoppage of the paper feed rollers through the comparison of the detector output and a threshold value.

Figure 20:
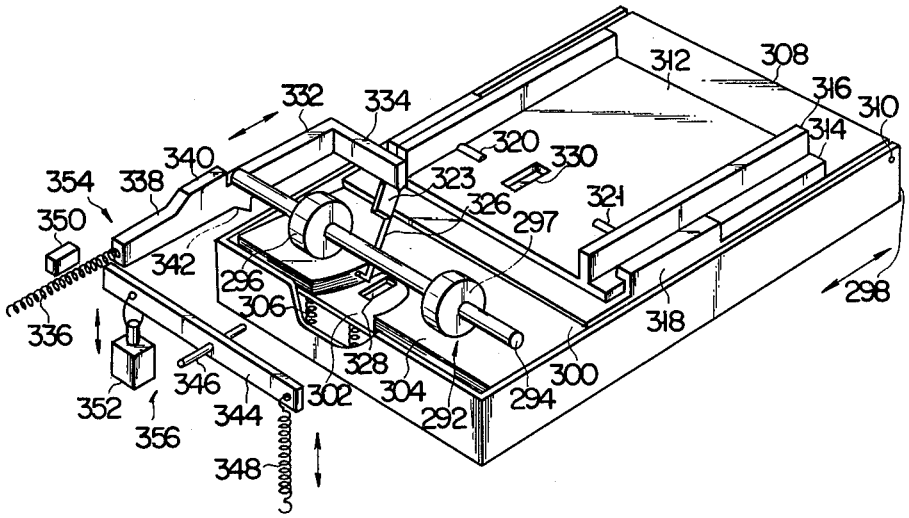
FIGS. 20 and 21 are perspective views showing a yet another embodiment of the paper feed device according to the invention, in which a manual paper supply mode is automatically switched back to a cassette paper supply mode according to a signal from a paper supply switch, with FIG. 20 showing the device in the cassette paper supply mode and FIG. 21 showing the device in the manual paper supply mode.

FIG. 20 shows a yet another embodiment, in which a manual paper supply mode is automatically switched back to a cassette paper supply mode according to a signal from a paper supply switch.

Referring to the Figure, designated at 292 is a paper feed mechanism including a rotative shaft 294 carrying two paper feed rollers 296 and 297 made of rubber, for instance. It is mounted as a component part in the frame of the electronic duplicator shown in FIG. 3. Designated at 298 is a paper feed cassette having a top opening 300 and accommodates an underlay plate 302. A number of paper sheets (i.e., transfer paper sheets) 304 are stacked on the underlay plate 302. The cassette 298 also accommodates coil springs 306 upwardly urging the underside of a front portion of the underlay plate 302 (and paper sheets 304). A rear portion of the top opening 300 of the cassette 298 is closed by a cassette cover 308. The cassette cover 308 has a rectangular shape, and its opposite sides are pivoted at the rear end by pins 310 to the opposite side walls of the cassette 298. A cassette paper supply section is constituted by the front open portion of the cassette 298, in which the top of the accommodated paper sheet stack 304 is exposed, that is, the cassette 298 is set in a predetermined position such that the top of the front portion of the paper sheet stack 304 is in contact with the feed rollers 296 and 297. In the set state of cassette 298, the accommodated paper sheets 304 can be fed out one after another by the rollers 296 and 297 (to a paper transport path, for instance). For manual paper supply, a manual paper supply guide 312 is provided on the cassette cover 308. It has opposite side guide edges 314, 314 and vertical guide walls 316, 316. The guide edges 314, 314 of the guide 312 are engaged in respective guide members 318, 318 which are provided on the cassette cover 308 along the opposite sides thereof, and the guide 312 can be moved back and forth relative thereto. When the guide 312 is held in its operative position, paper sheet can be manually supplied under the guide of its top guide surace. The guide 312 has driven rollers 320 and 321 rotatably mounted in its front portion and slightly raised relative to its top. In other words, the driven rollers 320 and 321 are brought to their operative position to co-operate with the feed rollers 296 and 297 for (to a paper transport path, for instance) feeding a manually supplied paper sheet when the guide 312 is advanced to its regular operative position after the cassette 298 is loaded in the regular porition.

A paper detecting switch 323 is provided in the neighborhood of the paper feed mechanism 292, and it is mounted on the electronic duplicator frame as shown in FIG. 3. The detecting switch 323 has an actuator 326, which extends from the underside of its casing down to a position below the rotative shaft 294. The underlay plate 302 is formed in its front portion corresponding to the end of the actuator 326 with a slot 328. Likewise, the manual paper supply guide 312 is formed in its front portion corresponding to the position of installation of the switch 323 with a slot 330. In a cassette paper supply mode, the actuator 326 is in contact with the top of the paper sheet stack 304 while it is vertically aligned to the slot 328 via the paper. Thus, as soon as all paper sheets in the cassette are used up, the actuators 326, 326 are allowed to swing into the slot 96, whereby the absence-of-paper is detected. In a manual paper supply mode, the slot 330 of the manual paper supply guide 312 is held such that it opposes the actuator 326 of the detecting switch 323, and the leading and trailing edges of a manually supplied sheet can be detected with the swinging action of the actuator 326 with respect to the slot 330.

A substantially L-shaped actuating member 332 is provided on electronic duplicator frame. It is found adjacent to one side of the front of the paper feed cassette 298 such that it can be advanced and retreated relative thereto and that its bent portion 334 is engaged with the front end of the vertical guide wall 316 on the corresponding side. The operating member 332 is spring biased in the direction opposite to the direction of paper supply by the restoring force of a coil spring 336 connected to its end remote from the bent portion 334. A longitudinal portion 338 of the operating member 332 has an upwardly raised portion 340 for operating switch and also a downwardly projecting stopper 342. Ahead of the cassette 298 is found a bar-like engagement member 344 crossing the operating member 332 and pivotably supported at the center by a shaft 346. An end portion (i.e., free end portion) of the engagement member 344 extends under the operating member 332 and is adapted to engage the stopper 342 of the operating member 332 when the operating member 332 is advanced in the direction of paper supply. The other end (i.e., stem end) of the engagement member 344 is spring biased counterclockwise by a coil spring 348 connected to it. With the biasing force of this spring the free end of the engagement member 344 is adapted to be held engaged with the stopper 342 to maintain a manual paper supply state. This manual paper supply state, i.e., manual paper supply mode, is detected as a mode detection switch 350 provided above the operating member 332 in the neighborhood of the biased end thereof is operated by the raised portion 340 of the operating member 332. The free end of the engagement member 344 mentioned above is coupled to a plunger solenoid 352, and the state of engagement between the engagement member 344 and stopper 342, i.e., the manual paper supply state, is released with the energization of the solenoid 352. The operating member 332, spring 336, engagement member 344 and spring 348 constitute a holding mechanism 354 for maintaining the manual paper supply state with the manual paper supply guide 312, and the stopper 342 and solenoid 352 constitute a releasing mechanism 356 for releasing the holding state of the mechanism 354.

Figure 22:
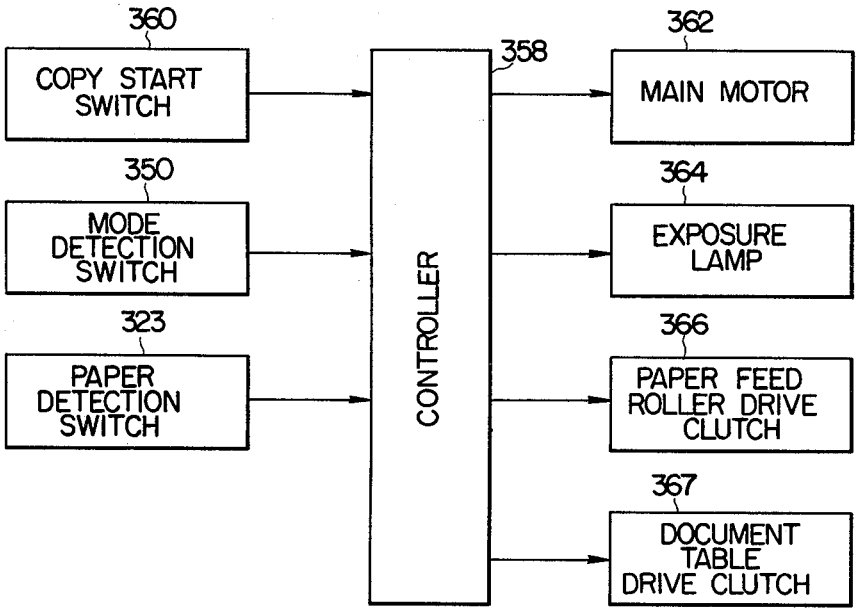
FIG. 22 is a block diagram showing a control system in the embodiment of FIGS. 20 and 21.

FIG. 22 shows a block diagram outlining a control system for this embodiment. The system includes a controller 358, which is mainly constituted by a microcomputer (for instance TMS 1300 by Texas Instrument Inc.), and to which the aforementioned paper detection switch 323 and a copying start switch 360 provided on an operation panel (not shown) are connected. Also, a main motor 362 for driving the document table, photosensitive drum and paper transport path of the electronic duplicator, an exposure lamp 364, a paper feed roller drive clutch 366 for coupling the aforementioned paper feed rollers 296 and 297 to the drive section and a document table drive clutch 368 for coupling the document table to its drive section are connected to the controller 358.

Figure 21:
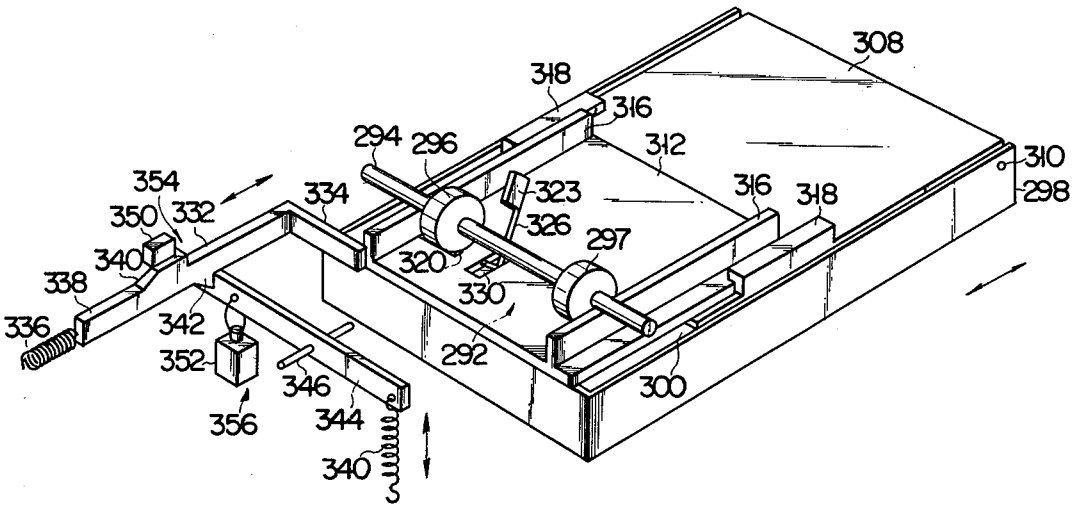
Figure 23:
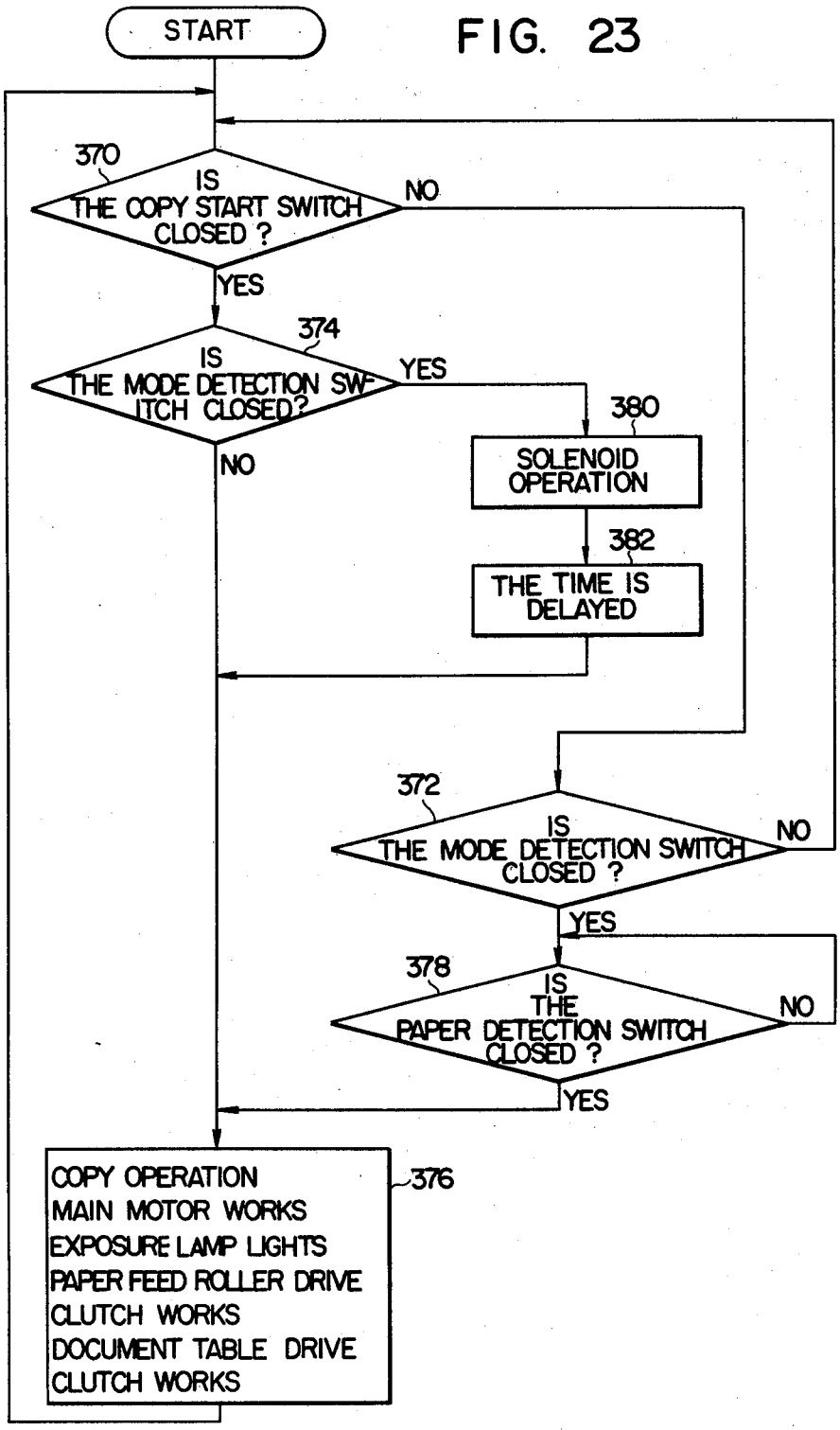
FIG. 23 is an operation flow chart illustrating the operation of the embodiment of FIGS. 20 and 21.

Now, the operation of the paper feed device of the above construction will be described with reference to the flow chart of FIG. 23. First, the case of cassette paper supply will be described. For cassette paper supply, the paper feed cassette 298 accommodating paper sheets 304 is set in the proper position in the paper feed mechanism 292 as shown in FIG. 20. At this time, the manual paper supply guide 312 is held retreated in a rear portion of the cassette 298. Thus, the mode detection switch 350 is rendered inoperative (i.e., turned off) and provides a cassette paper supply mode signal to the controller 358. As a result, the duplicator is held in a ready-to-copy state, and the controller 358 repeates successive steps 370 and 372. When the copying start switch 360 is turned on in this state, the controller 358 receives the switch output and executes steps 370, 374 and 376 to turn on the main motor 362 and exposure lamp 364 and couple the paper feed roller drive clutch 366 and document table clutch 368 for starting copying operation. With the coupling of the paper feed roller drive clutch 366 the shaft 294 of the paper feed rollers 296 and 297 is coupled to the drive section to rotate the rollers 296 and 297. As a result, the uppermost copying paper sheet 304 in the cassette 298 is taken out and fed forward to the paper transport path. When copying operation is ended, the controller 358 returns to the step 370, and the ready-to-copy state by cassette paper supply is established again. Now, the case of manually supplying a paper sheet of a different size, i.e., effecting manual paper supply, by interrupting the aforementioned cassette paper supply mode will be described. To this end, the manual paper supply guide 312 which has been held in an inoperative state is manually advanced, whereby the operating member 332 is pushed forward against the spring force of the spring 336. At this time, the free end of the engagement member 344 is pushed down by the stopper 342 of the operating member 332 moving forward against the spring force of the spring 348. As soon as the stopper 342 clears the free end of the engagement member 344, this end is raised by the tensile force of the spring 348. At this time, the guide 312 is adapted to reach its proper operative position as shown in FIG. 21, and it is held in that position owing to the engagement between the engagement member 344 and stopper 342. Coincidentally, the raised portion 340 of the operating member 332 reaches the mode detection switch 350 and operates (i.e., turn on) it, causing it to provide a manual paper supply mode signal to the controller 358. In this way, the cassette paper supply mode is switched over to the manual paper supply mode. As a result, the controller 358 is allowed to execute successive steps 370, 372 and 378, and the duplicator is held in a ready-to-copy state with the controller 358 repeating the step 378. When a paper sheet is manually fed forward along the top surface of the guide 312 toward the paper feed rollers 296 and 297, the paper detection switch 323 is operated (i.e., turned on) by the leading edge of the paper. With an output signal produced from this switch, the controller 358 proceeds from the step 378 to the step 376 to start the copying operation. At this time, the paper feed rollers 296 and 297 are rotated by the action of the paper feed roller drive clutch 366 as mentioned earlier, so that the paper inserted under the paper feed rollers 296 and 297 on one hand and the driven rollers 320 and 321 on the other hand is fed on by these rollers to the paper transport path. When copying operation is ended, the controller 358 returns to the step 370, and the ready-to-copy state by manual paper supply is established again.

For switching the manual paper supply mode back to the cassette paper supply mode again, the copying start switch 360 is turned on, whereby the cassette paper supply state is automatically recovered for commencing copying operation by cassette paper supply. More particularly, when the copying start switch 360 is turned on in the manual paper supply mode, the controller 358, receiving an output from the switch, executes successive steps 370, 374, 380, 382 and 376. As a result, the solenoid 352 is energized, and copying operation is started after a predetermined delay time (for instance about 0.5 second) required for the recovery of the cassette paper supply mode. More particularly, with the energization of the solenoid 352 the free end of the engagement member 344 is pulled down against the tensile force of the spring 348 and disengaged from the stopper 342. As a result, the operating member 332 is retreated together with the guide 312 in the direction opposite to the direction of paper supply by the restoring force of the spring 336, whereby the cassette supply state as shown in FIG. 20 is recovered. At this time, the raised portion 340 of the operating member 332 leaves the mode detection switch 350, whereby the switch 350 is restored (i.e., turned off) to produce a cassette paper supply mode signal to the control section 358. In this way, the manual paper supply mode is switched over to the cassette paper supply mode. As has been shown, with the operation of the copying start switch 360 in the manual paper supply mode this mode is released and the cassette paper supply mode is recovered automatically, and copying operation is subsequently started.

Figure 24:
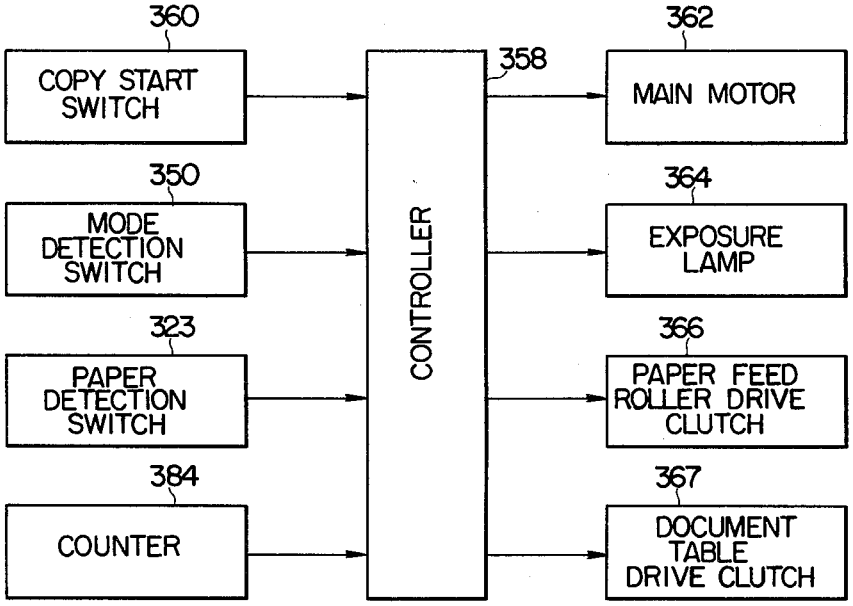
FIG. 24 is a block diagram showing a control system in a modification of the embodiment of FIGS. 20 and 21, in which manual paper supply mode is automatically switched back to cassette paper supply mode according to a signal from a timer.

FIG. 24 shows a modification of the control system shown in FIG. 22.

While in the system of FIG. 22 a signal from a paper supply switch has been used for resetting the manual paper supply guide, in this modification the guide is reset after the lapse of a predetermined delay time from the appearance of the switch signal.

To realize this, a counter 384 is further connected to the controller 358 shown in FIG. 24. The other parts or circuits connected to the controller are the same as those in the previous system of FIG. 22, so they are designated by like reference numerals and are not described here.

Figure 25:
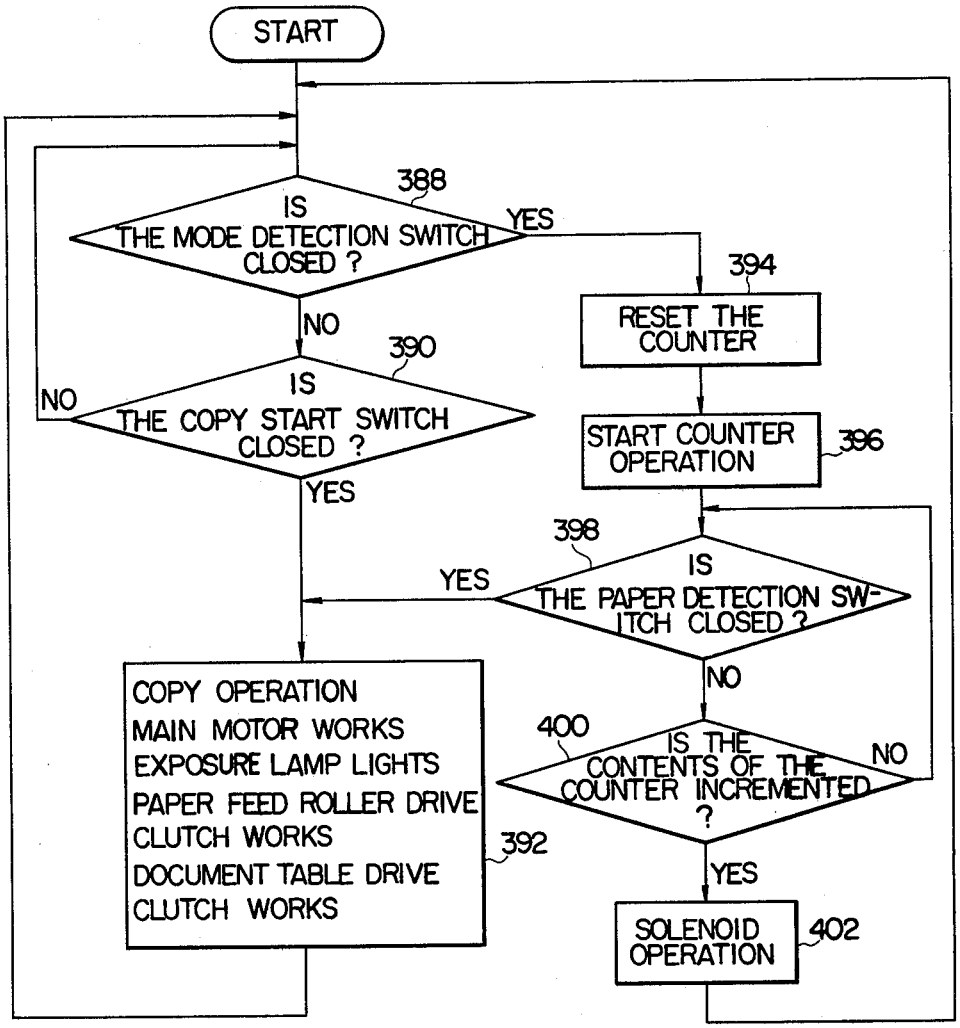
FIG. 25 is an operation flow chart illustrating the operation of the modification of FIG. 24.

Now, the operation of the paper feed device of the above construction will be described with reference to the flow chart of FIG. 25. First, the case of cassette paper supply will be described. For cassette paper supply, the paper feed cassette 298 accommodating paper sheets 304 is set in the proper position in the paper feed mechanism 292 as shown in FIG. 20. At this time, the manual paper supply guide 312 is held retreated in a rear portion of the cassette 298. Thus, the mode detection switch 350 is rendered inoperative (i.e., turned off) and provides a cassette paper supply mode signal to the controller 358. As a result, the duplicator is held in a ready-to-copy state with the controller 358 repeating successive steps 388 and 390. When the copying start switch 360 is turned on in this state, the controller 358 receives the switch output and executes a step 392 to turn on the main motor 362 and exposure lamp 364 and couple the paper feed roller drive clutch 366 and document table clutch 368 for starting copying operation. With the coupling of the paper feed roller drive clutch 366 the shaft 294 of the paper feed rollers 296 and 297 is coupled to the drive section to rotate the rollers 296 and 297. As a result, the uppermost copying paper sheet 304 in the cassette 298 is taken out and fed forward to the upper transport path. When copying operation is ended, the controller 358 returns to the step 370, and the ready-to-copy state by cassette paper supply established again.

For manually supplying a paper sheet by interrupting the above cassette paper supply mode, the manual paper supply guide 312 which has been held in an inoperative state is manually advanced and set in the regular operative position for manual paper supply. With this action, the operating member 332 is pushed forward against the spring force of the spring 336. At this time, the free end of the engagement member 344 is pushed down by the stopper 342 of the operating member 332 moving forward against the spring force of the spring 348. As soon as the stopper 342 clears the free end of the engagement member 344, this end is raised by the tensile force of the spring 348. At this time, the guide 312 reaches the operative position as shown in FIG. 21 and is held in that position due to the engagement between the engagement member 344 and stopper 342. Coincidentally, the raised portion 340 of the operating member 332 reaches the mode detection switch 350 and operates (i.e., turn on) it, causing it to provide a manual paper supply mode signal to the controller 358. In this way, the cassette paper supply mode is switched over to the manual paper supply mode. As a result, the controller 358 is allowed to execute successive steps 388, 394 and 396, resetting the counter 384 in the step 394 and starting counter operation in the step 396. Thus, the duplicator is held in a ready-to-copy state, and the controller 358 repeatedly executes successive steps 398 and 400 until the insertion of a manual supply paper sheet. If a manual supply paper sheet is inserted within a predetermined period of time for instance 30 seconds) until the counter 384 makes a count-up, copying operation is started. As a manual supply paper sheet is inserted under the paper feed rollers 296 and 297 from behind along the top surface of the manual paper supply guide 312, its leading edge operates (i.e., turn on) the paper detection switch 323. With an output signal the paper detection switch 323 thus produced and coupled to it, the controller 358 proceeds from the step 398 to the step 392 to start the copying operation. At this time, the paper feed rollers 296 and 297 are rotated by the action of the paper feed roller drive clutch 366 as mentioned earlier, so that the paper inserted between the rollers 296 and 297 on one hand and the driven rollers 320 and 321 on the other hand fed on by these rollers to the paper transport path. When copying operation is ended, the controller 358 returns to the step 388. In this modification, the manual paper supply mode remains in force at this time. Thus, the controller 358 executes the step 394 to reset the counter 384 and then the step 396 to start counter operation again. In this way, the ready-to-copy state by manual paper supply is established again, and the controller 358 repeatedly executes the steps 398 and 400. It is to be understood that the counter 384 is reset to start counting operation afresh after the insertion of each manual supply paper sheet.

If no manual paper supply sheet is inserted within the aforementioned predetermined period of time, the cassette paper supply state is automatically recovered. More particularly, without any manual paper sheet inserted while the ready-to-copy state is maintained, a count-up of the counter 384 is caused, and with a signal produced therefrom the controller 358 proceeds from the step 400 to the step 402. With the solenoid 352 operated, the free end of the engagement member 344 is lowered against the tensile force of the spring 348, thus disengaging it from the stopper 342. As a result, the operating member 332 is retreated together with the manual paper supply guide 312 in the direction opposite to the direction of paper supply by the restoring force of the spring 336, whereby the cassette supply state as shown in FIG. 20 is recovered. At this time, the raised portion 340 of the operating member 332 leaves the mode detection switch 350, whereby the switch 350 is restored (i.e., turned off) to produce a cassette paper supply mode signal to the control section 358. In this way, the manual paper supply mode is switched over to the cassette paper supply mode, that is, the ready-to-copy state by cassette paper supply is established again and the controller 358 repeates the steps 388 and 390.

What we claim is:

1. A paper feed device comprising:

(a) a paper feed cassette accommodating paper sheets;

(b) a paper feed mechanism for feeding paper from said paper feed cassette;

(c) a manual paper supply guide means provided on or near said paper feed cassette and movable between a position to permit cassette paper supply and a position to permit manual paper supply; and (d) locking means for holding said manual paper supply guide means in said position to permit manual paper supply at the time of manual paper supply mode and for releasing said guide means from said manual paper supply position to automatically switch the manual paper supply mode to a cassette paper supply mode according to an externally coupled signal for bringing about the cassette supply mode.

2. A paper feed device comprising:

(a) a paper feed cassette accommodating paper sheets;

(b) manual paper supply guide means provided on or near said paper feed cassette and movable between a position to permit manual paper supply and a position to permit cassette paper supply;

(c) paper feed means for feeding paper manually supplied with aid of said manual paper supply guide means or paper from said paper feed cassette;

(d) holding means for holding said manual paper supply guide means in said position to permit manual paper supply;

(e) releasing means for releasing said holding means from the holding state thereof; and (f) a control means for actuating said releasing means according to a signal from a paper feed switch in said manual paper supply mode.

3. A paper feed device comprising:

(a) a paper feed cassette accommodating paper sheets;

(b) manual paper supply guide means provided on or near said paper feed cassette and movable between a position to permit manual paper supply and a position to permit cassette paper supply;

(c) paper feed means for feeding paper manually supplied with aid of said manual paper supply guide means or paper from said paper feed cassette;

(d) holding means for holding said manual paper supply guide means in said position to permit manual paper supply;

(e) releasing means for releasing said holding mechanism from the holding state thereof;

(f) timer means for producing an output signal after the lapse of a predetermined period of time from the instant when said holding state of said holding mechanism is brought about; and (g) control means for operating said releasing mechanism according to the output signal from said timer.

4. A paper feed device according to claim 2 or 3, wherein said control means includes a microcomputer.

5. A paper feed device, comprising:

a paper feed cassette accommodating paper sheets;

manual paper supply guide means provided on or near said paper feed cassette and which can be set between a position to permit manual paper supply and a position to permit cassette paper supply;

paper feed means for feeding paper manually supplied with aid of said manual paper supply guide means or paper from said paper feed cassette;

holding means for holding said manual paper supply guide means in said position to permit manual paper supply; and releasing means for releasing said holding means from the holding state thereof.

6. A paper feed device according to claim 5, further comprising releasing signal generating means operatively connected to said releasing means for generating a releasing signal and wherein said releasing means actuates said holding means in response to receiving said releasing signal from said releasing signal generating means.

7. A paper feed device according to claim 5, further comprising a control means for actuating said releasing mechanism in said manual paper supply mode.

8. A paper feed device according to claim 7, wherein said control means includes a microcomputer.

9. A paper feed device according to claim 7, further comprising releasing signal generating means operatively connected to said control means for generating a releasing signal and wherein said control means actuates said releasing means in response to receiving said releasing signal from said releasing signal generating means.

10. A paper feed device according to claim 7, further comprising switch means incorporated with the paper feed cassette and operatively connected to said control means for generating a copy start signal and wherein said control means actuates said releasing means in response to said copy start signal.

11. A paper feed device according to claim 7, further comprising timer means for producing an output signal after the lapse of a predetermined period of time from the instant when said holding state of said holding means is brought about, wherein said control means actuates said releasing means according to the output signal from said timer means.

* * * * *